US009320365B2

(12) United States Patent
Fortuna et al.

(10) Patent No.: US 9,320,365 B2
(45) Date of Patent: Apr. 26, 2016

(54) PRODUCT DISPENSING SYSTEM WITH SOUND REDUCING FEATURES

(75) Inventors: James Fortuna, Richmond, VA (US); Caleb Loftin, Richmond, VA (US); Joseph Snead, Chesterfield, VA (US)

(73) Assignee: WestRock MWV, LLC, Norcross, GA (US)

( * ) Notice: Subject to any disclaimer, the term of this patent is extended or adjusted under 35 U.S.C. 154(b) by 750 days.

(21) Appl. No.: 13/601,237

(22) Filed: Aug. 31, 2012

(65) Prior Publication Data

US 2014/0061217 A1 Mar. 6, 2014

(51) Int. Cl.

| | |
|---|---|
| ***A47F 1/04*** | (2006.01) |
| ***A47F 1/08*** | (2006.01) |
| *B65D 5/72* | (2006.01) |

(52) U.S. Cl.

CPC ..... *A47F 1/087* (2013.01); *B65D 5/725* (2013.01); *B65D 5/726* (2013.01)

(58) Field of Classification Search

CPC ..... G07F 11/045; G07F 11/02; G07F 11/04; A47F 1/087; A47F 1/12; B65D 5/5206; B65D 5/725; B65D 71/36; B65D 2571/00617; B65D 2571/0066; B65D 2571/00728; B65D 2571/00141; B65D 5/726; Y10S 83/946

USPC ..... 211/59.2

See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,858,199 | A | 10/1932 | Maziroff |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |
| 2,291,187 | A | 7/1942 | Johnson |
| 2,382,191 | A | 7/1944 | Weichselbaum |
| 2,536,421 | A | 2/1951 | Burhans |
| 2,573,381 | A | 10/1951 | Arnold |
| 2,574,087 | A | 11/1951 | Burhans |
| 2,595,122 | A | 4/1952 | Burhans |
| 2,732,619 | A | 1/1956 | Labine |

(Continued)

FOREIGN PATENT DOCUMENTS

| | | |
|---|---|---|
| AT | 6036 U1 | 3/2003 |
| DE | 2655496 | 6/1978 |

(Continued)

*Primary Examiner* — Korie H Chan

(74) *Attorney, Agent, or Firm* — WestRock IP Legal

(57) ABSTRACT

A product dispensing system having a frame with a front end and a rear end, and including an upper support deck extending between the front end and the rear end, a lower support deck positioned below the upper support deck, the lower support deck extending between the front end and the rear end and defining a product display area, a guide extending from proximate the upper support deck to proximate the lower support deck, and a stop positioned proximate the product display area.

19 Claims, 15 Drawing Sheets

(56) References Cited

U.S. PATENT DOCUMENTS

| | | | |
|---|---|---|---|
| 2,784,871 | A | 3/1957 | Gabrielsen |
| 2,795,845 | A | 6/1957 | Shimer |
| 2,818,978 | A | 1/1958 | Post |
| 2,826,471 | A | 3/1958 | Fonda |
| 2,831,591 | A | 4/1958 | Morton |
| 2,888,145 | A | 5/1959 | Knott et al. |
| 2,915,932 | A | 12/1959 | Gross |
| 2,919,488 | A | 1/1960 | Brownlee |
| 2,996,344 | A | 8/1961 | Garman |
| 3,018,149 | A | 1/1962 | Parker |
| 3,055,293 | A | 9/1962 | Lariccia |
| 3,066,827 | A | 12/1962 | Pryor |
| 3,137,068 | A | 6/1964 | Quigley |
| D198,888 | S | 8/1964 | Heselov |
| 3,178,242 | A | 4/1965 | Ellis et al. |
| 3,184,104 | A | 5/1965 | De Domenico et al. |
| 3,203,554 | A | 8/1965 | Pendergrast et al. |
| 3,204,335 | A | 9/1965 | Hughes |
| 3,288,544 | A | 11/1966 | Knecht |
| 3,300,115 | A | 1/1967 | Schauer |
| 3,304,141 | A | 2/1967 | Rogers |
| 3,306,688 | A | 2/1967 | Di Domenico |
| 3,318,455 | A | 5/1967 | Takahashi |
| 3,335,940 | A | 8/1967 | Dykes |
| 3,340,790 | A | 9/1967 | Simjian |
| 3,348,738 | A | 10/1967 | Hertlein |
| 3,392,901 | A | 7/1968 | Krzyzanowski |
| 3,393,808 | A | 7/1968 | Chirchill |
| 3,501,016 | A | 3/1970 | Eaton |
| 3,763,557 | A | 10/1973 | Sewell |
| 3,784,022 | A | 1/1974 | Beesley, Jr. |
| 3,922,778 | A | 12/1975 | Aalpoel |
| 3,923,159 | A | 12/1975 | Taylor et al. |
| 3,972,454 | A | 8/1976 | Croley |
| 4,105,126 | A | 8/1978 | Deffner et al. |
| 4,205,440 | A | 6/1980 | Morgan |
| 4,260,072 | A | 4/1981 | Quasarano |
| 4,318,458 | A | 3/1982 | Ritsema |
| 4,382,526 | A | 5/1983 | Stone |
| 4,396,143 | A | 8/1983 | Killy |
| 4,435,026 | A | 3/1984 | Johnson |
| 4,467,524 | A | 8/1984 | Ruff et al. |
| 4,576,272 | A | 3/1986 | Morgan, Jr. |
| 4,598,828 | A | 7/1986 | Young et al. |
| 4,729,480 | A | 3/1988 | Groover et al. |
| 4,744,489 | A | 5/1988 | Binder et al. |
| 4,834,263 | A | 5/1989 | Becze |
| 4,869,395 | A | 9/1989 | Rubbmark |
| 4,911,309 | A | 3/1990 | Stefan |
| 4,915,571 | A | 4/1990 | Toshihiko et al. |
| 4,923,070 | A | 5/1990 | Jackle et al. |
| 4,997,106 | A | 3/1991 | Rockola |
| 4,998,628 | A | 3/1991 | Ross |
| 5,033,348 | A | 7/1991 | Walsh |
| 5,080,256 | A | 1/1992 | Rockola |
| 5,101,703 | A | 4/1992 | Tanaka et al. |
| 5,167,345 | A | 12/1992 | Bleeker |
| 5,190,155 | A | 3/1993 | Grunwald |
| 5,251,972 | A | 10/1993 | Zurawin |
| 5,289,943 | A | 3/1994 | Powell |
| 5,314,078 | A | 5/1994 | Morikiyo et al. |
| 5,328,258 | A | 7/1994 | Scalise |
| 5,356,033 | A | 10/1994 | Delaney |
| 5,372,278 | A | 12/1994 | Leight |
| 5,390,821 | A | 2/1995 | Markel |
| 5,396,997 | A | 3/1995 | Johnson |
| D363,174 | S | 10/1995 | Fletcher, Sr. |
| 5,462,198 | A | 10/1995 | Schwimmer |
| 5,529,207 | A | 6/1996 | Oden et al. |
| 5,638,988 | A | 6/1997 | Rogers |
| 5,685,664 | A | 11/1997 | Parham et al. |
| 5,740,610 | A | 4/1998 | Ayer et al. |
| 5,788,117 | A | 8/1998 | Zimmanck |
| 5,791,048 | A | 8/1998 | Bodnar et al. |
| 5,836,478 | A | 11/1998 | Weiss |
| 5,878,862 | A | 3/1999 | Dewsnap |
| 5,894,942 | A | 4/1999 | Miyashita et al. |
| 5,924,573 | A | 7/1999 | Piraneo et al. |
| 5,992,286 | A | 11/1999 | Boole |
| 5,992,652 | A | 11/1999 | Springs |
| 6,186,345 | B1 | 2/2001 | Robertson |
| 6,199,720 | B1 | 3/2001 | Rudick et al. |
| 6,206,237 | B1 | 3/2001 | Dillon et al. |
| 6,253,930 | B1 | 7/2001 | Freidus et al. |
| 6,267,258 | B1 | 7/2001 | Wilkerson et al. |
| 6,393,799 | B2 | 5/2002 | Jenkins et al. |
| 6,453,641 | B1 | 9/2002 | Puckett |
| 6,637,604 | B1 | 10/2003 | Jay |
| 6,802,433 | B2 | 10/2004 | Leykin |
| 6,991,116 | B2 | 1/2006 | Johnson et al. |
| 7,207,447 | B2 | 4/2007 | Medcalf et al. |
| 7,303,095 | B2 | 12/2007 | Nagelski et al. |
| 7,546,973 | B2 | 6/2009 | Budz et al. |
| 7,584,854 | B2 | 9/2009 | Chandaria |
| 7,614,543 | B1 | 11/2009 | Miller |
| D604,972 | S | 12/2009 | Henry et al. |
| 7,665,618 | B2 | 2/2010 | Jay et al. |
| 7,681,745 | B2 | 3/2010 | Richter |
| 7,690,518 | B2 | 4/2010 | Fincher et al. |
| 7,757,890 | B2 | 7/2010 | Alford et al. |
| 7,810,672 | B1 | 10/2010 | Mason et al. |
| 7,823,733 | B2 | 11/2010 | Futori |
| 7,841,479 | B2 | 11/2010 | Budge et al. |
| 7,850,015 | B1 | 12/2010 | Mason |
| 7,913,860 | B2 | 3/2011 | Merl |
| 7,918,365 | B2 * | 4/2011 | White et al. ..... 221/191 |
| 7,922,437 | B1 | 4/2011 | Loftin et al. |
| 7,992,747 | B2 | 8/2011 | Bauer |
| 8,028,855 | B2 | 10/2011 | White et al. |
| 8,047,400 | B1 | 11/2011 | Luberto et al. |
| 8,302,809 | B1 | 11/2012 | Bogdziewicz et al. |
| 8,308,023 | B2 | 11/2012 | Gelardi et al. |
| 2002/0043509 | A1 | 4/2002 | Lajeunesse et al. |
| 2003/0173322 | A1 | 9/2003 | Rushing |
| 2004/0011751 | A1 | 1/2004 | Johnson et al. |
| 2004/0079760 | A1 | 4/2004 | Rink |
| 2004/0262326 | A1 * | 12/2004 | Christensen ..... 221/281 |
| 2005/0092644 | A1 | 5/2005 | Cafferata |
| 2005/0127015 | A1 | 6/2005 | Medcalf et al. |
| 2005/0207877 | A1 | 9/2005 | Haverdink |
| 2006/0081692 | A1 | 4/2006 | Stewart et al. |
| 2006/0237384 | A1 | 10/2006 | Neumann et al. |
| 2006/0243683 | A1 | 11/2006 | Onachilla et al. |
| 2006/0278591 | A1 | 12/2006 | Tippets et al. |
| 2007/0194037 | A1 | 8/2007 | Close |
| 2008/0245813 | A1 | 10/2008 | Johnson et al. |
| 2009/0212066 | A1 | 8/2009 | Bauer |
| 2009/0266776 | A1 | 10/2009 | Johnson |
| 2009/0277853 | A1 | 11/2009 | Bauer |
| 2009/0308885 | A1 | 12/2009 | Sainato et al. |
| 2010/0032391 | A1 | 2/2010 | Schneider et al. |
| 2010/0096401 | A1 | 4/2010 | Sainato et al. |
| 2010/0295424 | A1 * | 11/2010 | Alexander ..... 312/109 |
| 2011/0121010 | A1 | 5/2011 | Loftin et al. |
| 2011/0121011 | A1 * | 5/2011 | Gelardi et al. ..... 221/30 |
| 2011/0121022 | A1 | 5/2011 | Sholl et al. |
| 2012/0018391 | A1 | 1/2012 | Gelardi et al. |
| 2012/0074016 | A1 | 3/2012 | Gelardi et al. |
| 2012/0074160 | A1 | 3/2012 | Thomas et al. |
| 2012/0074164 | A1 | 3/2012 | Walling et al. |
| 2012/0080513 | A1 | 4/2012 | Thomas et al. |
| 2012/0097694 | A1 | 4/2012 | Gelardi |
| 2012/0152970 | A1 | 6/2012 | Thomas |
| 2012/0211522 | A1 | 8/2012 | Gelardi et al. |
| 2012/0217213 | A1 | 8/2012 | Thomas |
| 2012/0217261 | A1 | 8/2012 | Bailey et al. |
| 2012/0223090 | A1 | 9/2012 | Thomas et al. |
| 2012/0279893 | A1 | 11/2012 | Gelardi et al. |
| 2012/0285976 | A1 | 11/2012 | Bogdziewicz et al. |

(56) References Cited

U.S. PATENT DOCUMENTS

| | | | | |
|---|---|---|---|---|
| 2012/0285977 | A1 | 11/2012 | Bates et al. | |
| 2015/0014261 | A1* | 1/2015 | Johnson et al. | 211/59.2 |

FOREIGN PATENT DOCUMENTS

| | | | |
|---|---|---|---|
| DE | 29808673 | | 12/1998 |
| DE | 20111307 | | 11/2001 |
| DE | 202007012114 | U1 | 12/2007 |
| DE | 19808162 | | 5/2009 |
| FR | 2415051 | | 8/1979 |
| GB | 1283210 | | 7/1972 |
| GB | 2190906 | | 12/1978 |
| GB | 2303624 | | 2/1997 |
| JP | 1991273474 | | 4/1991 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO 9106076 | | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011030320 | | 3/2011 |
| WO | WO 2011109350 | | 9/2011 |

* cited by examiner

PRODUCT DISPENSING SYSTEM WITH SOUND REDUCING FEATURES

FIELD

This application relates to the dispensing of products from packaging containers and, more particularly, to dispensers for dispensing products initially provided in packaging containers.

BACKGROUND

Products are typically shipped to retailers in bulk by enclosing multiple individual product units in a container, such as a carton or box. For example, canned beverages may be shipped to a retailer in a carton containing twelve or more individual cans. When the products are to be sold individually, the retailer must remove the individual product units from the carton and stack them on a display, such as a shelf.

Alternatives to the traditional package-ship-unpack-display model have been developed in an effort to improve operating efficiency. For example, U.S. Pat. No. 7,922,437 issued on Apr. 12, 2011, the entire contents of which are incorporated herein by reference, discloses a system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity.

A disadvantage to such product dispensing systems is the level of noise produced by the products as they are deposited from the container (e.g., paperboard carton) into the dispenser and the noise produced as the products are routed to the product display area under the force of gravity as the customer is shopping the product.

Despite advances already made in the field, those skilled in the art continue with research and development efforts directed to apparatus and systems for dispensing products initially provided in packaging containers.

SUMMARY

In one embodiment, the disclosed product dispensing system may include a dispenser frame having a front end and a rear end, the dispenser frame including an upper support deck extending between the front end and the rear end, a lower support deck positioned below the upper support deck, the lower support deck extending between the front end and the rear end and defining a product display area, wherein the dispenser frame defines a channel extending from the upper support deck down to the lower support deck, and an obstruction extending into said channel to interact with products moving through said channel down to said lower support deck.

In another embodiment, the disclosed product dispensing system may include a dispensing frame having a front end and a rear end, and including an upper support deck extending between the front end and the rear end, a lower support deck positioned below the upper support deck, the lower support deck extending between the front end and the rear end and defining a product display area, a guide extending from proximate the upper support deck to proximate the lower support deck, and a stop positioned proximate the product display area.

In another embodiment, the disclosed product dispensing system may include a dispensing frame having a front end and a rear end, and including an upper support deck extending between the front end and the rear end, a lower support deck positioned below the upper support deck, the lower support deck extending between the front end and the rear end and defining a product display area, an intermediate support deck positioned between the upper support deck and the lower support deck, said intermediate support deck extending between the front end and the rear end and defining a second product display area, a guide extending from proximate the upper support deck to proximate the lower support deck, a lower stop positioned proximate the first product display area, and an intermediate stop positioned proximate the second product display area.

In yet another embodiment, disclosed is a method for dispensing a plurality of product initially provided in a container. The method may include the steps of (1) providing a dispenser including a frame having a front end and a rear end, and including an upper support deck extending between the front end and the rear end, a lower support deck positioned below the upper support deck, the lower support deck extending between the front end and the rear end and defining a product display area, a guide extending from proximate the upper support deck to proximate the lower support deck, and a stop positioned proximate the product display area, (2) forming an opening in the container, and (3) positioning the container on the upper support deck such that a first quantity of products of the plurality of products passes through the opening and moves toward the product display area.

Other embodiments of the disclosed product dispensing system and method will become apparent from the following detailed description, the accompanying drawings and the appended claims.

DETAILED DESCRIPTION

Figure 1:
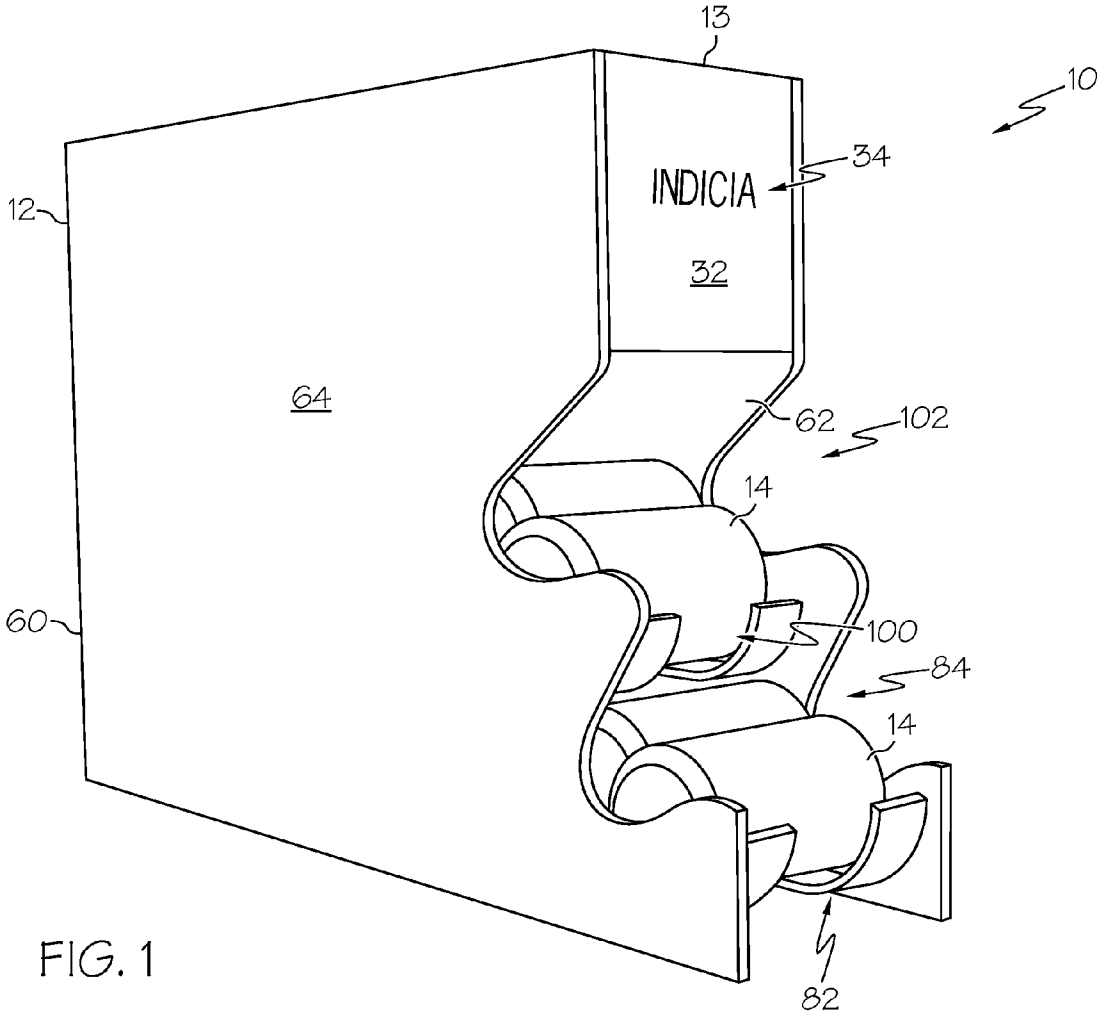
FIG. 1 is a front perspective view of one embodiment of a disclosed product dispensing system with sound reducing features.
Figure 2:
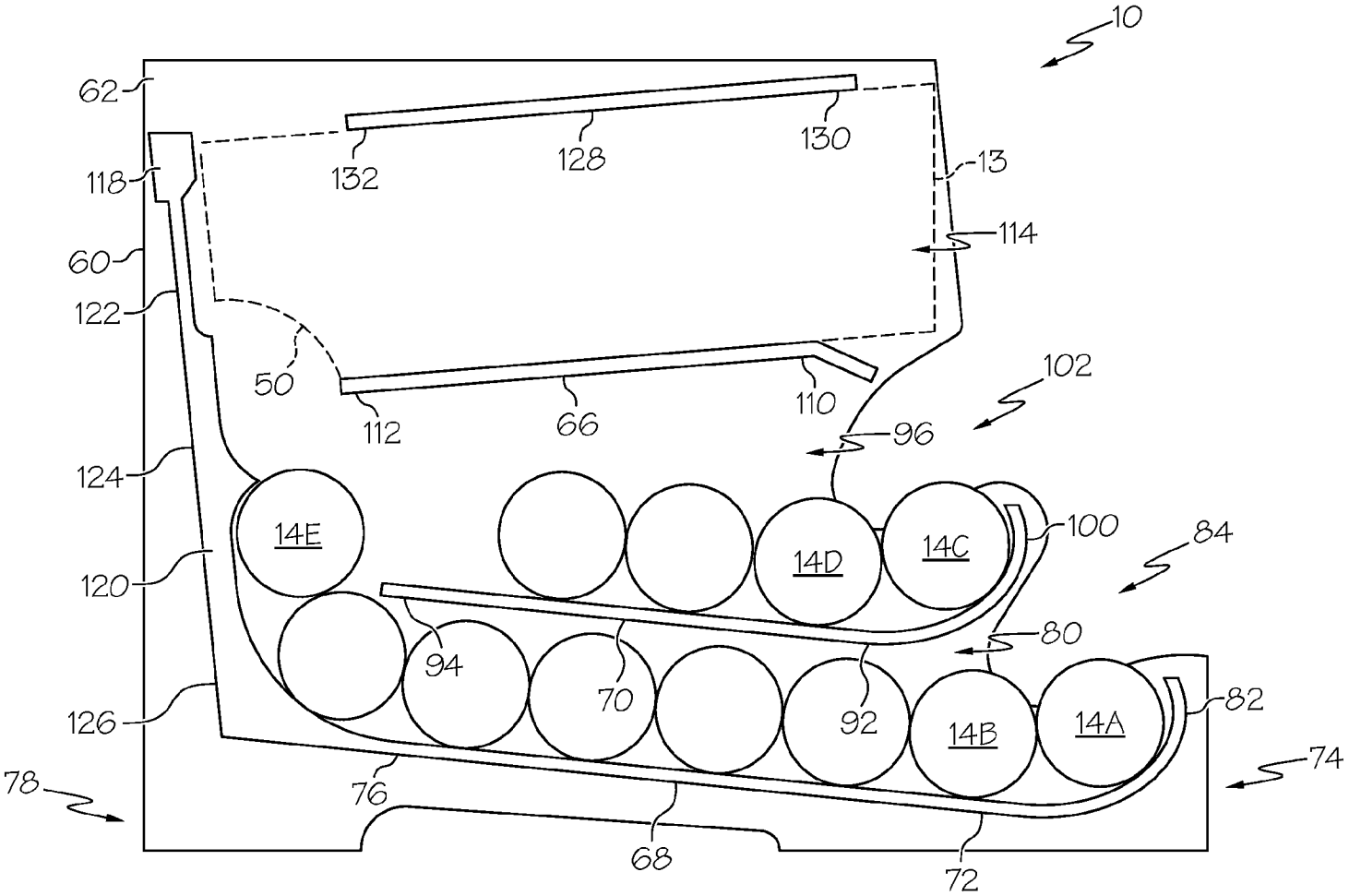
FIG. 2 is a side elevation view, in section, of the product dispensing system of FIG. 1.

Referring to FIGS. 1 and 2, one embodiment of the disclosed product dispensing system with sound reducing features, generally designated 10, may include a dispenser 12 and a container 13. The container 13, as described in more detail herein, may initially house multiple units of product 14, such as cans (e.g., canned soft drinks), jars (e.g., jarred soup) or bottles (e.g., bottled sauce). The products 14 may be released from the container 13 into the dispenser 12 when the container 13 is opened and loaded onto the dispenser 12. Materials used in construction are selected for sound dampening properties, particularly in locations where collisions between the walls and edges of the trays are likely to occur.

Figure 4:
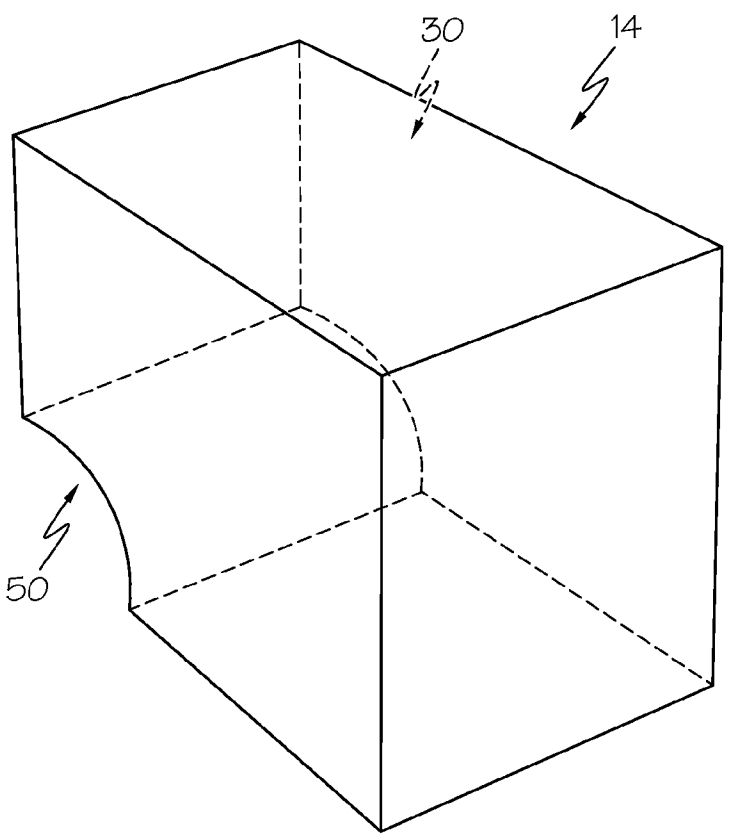
FIG. 4 is a front perspective view of the container of FIG. 3 shown in an open configuration.
Figure 3:
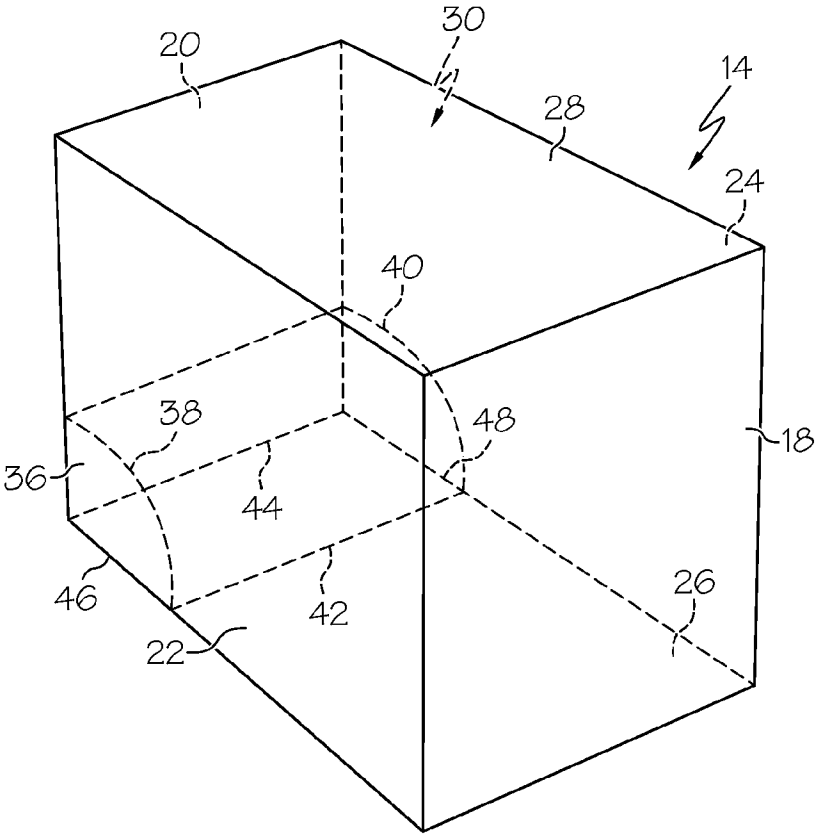
FIG. 3 is a front perspective view of a container of the product dispensing system of FIG. 1.

Referring next to FIGS. 3 and 4, the container 13 may be any container capable of initially housing the products 14 and beneficially interacting with the dispenser 12. For example, the container 13 may be a paperboard carton or a corrugated box having six walls 18, 20, 22, 24, 26, 28 that define an internal volume 30 for receiving the products 14. Opposed walls may define the front wall 18 and the rear wall 20 of the container 13. Opposed walls may define the left side wall 22 and the right side wall 24 of the container 13. Opposed walls may define the lower base wall 26 and the upper wall 28 of the container 13.

In accordance with well-established techniques, the container 13 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface of the container 13, and an uncoated second major surface. As another example, the stock material may be C2S paperboard, which may have a coating (e.g., clay) on both major surfaces thereof. Optionally, the outer surface 32 (illustrated in FIG. 1) of the container 13 may be marked with various container indicia 34 (FIG. 1), such as printed text and graphics, for example to identify the type of product 14 or the manufacturer of the product 14.

Still referring to FIG. 3, the container 13 may include a removable opening feature 36. The removable opening feature 36 may be defined by weakened severance lines 38, 40, 42, 44, 46, 48 formed in the rear wall 20, left side wall 22, right side wall 24 and the base wall 26 of the container 13. The weakened severance lines 38, 40, 42, 44, 46, 48 may be formed by weakening the container 13, such as with score lines, perforations or zipper-like cuts, to facilitate tearing of the container 13 along the weakened severance lines 38, 40, 42, 44, 46, 48.

Thus, as shown in FIG. 4, the removable opening feature 36 may be removed from the container 13 to form an opening 50 to access the internal volume 30 of the container 13. The opening 50 may extend generally laterally between the left side wall 22 and the right side wall 24 of the container 13 and may be positioned proximate the rear wall 20 of the container 13, such that the products 14 (FIG. 2) may exit the container 13 through the opening 50. Those skilled in the art will appreciate that the step of removing the removable opening feature 36 from the container 13 may be performed prior to loading the container 13 onto the dispenser 12.

Referring back to FIGS. 1 and 2, the dispenser 12 may include a frame 60 that supports the container 13 in a desired configuration, such as a slightly declined, but generally horizontal configuration (FIGS. 1 and 2). The frame 60 may include a first (e.g., right) side wall 62, a second (e.g., left) side wall 64, an upper support deck 66, a lower support deck 68, and one or more intermediate support decks 70 (only one intermediate support deck 70 is shown by example in FIGS. 1 and 2). The right side wall 62 may be laterally spaced from the left side wall 64 and may be generally parallel to the left side wall 64.

The frame 60 may be constructed from, or may include, sound dampening materials, such as foam. For example, sound dampening materials may be placed at various locations where the frame 60 may be impacted by moving products 14.

The lower support deck 68 may laterally extend between the right side wall 62 and the left side wall 64 of the frame 60 and may include a front end 72 that longitudinally extends toward the front end 74 of the frame 60 and a rear end 76 that longitudinally extends toward the rear end 78 of the frame 60. Therefore, the lower support deck 68 and the side walls 62, 64 may define a lower level 80 of the frame 60.

The lower support deck 68 may be inclined from the front end 72 to the rear end 76 (i.e., the rear end 76 may be elevated relative to the front end 72) such that products 14 deposited proximate the rear end 76 of the lower support deck 68 roll down to the front end 72 of the lower support deck 68 under the force of gravity. The extent of the incline of the lower support deck 68 may be dictated by, among other things, the coefficient of friction of the material used to form the frame 60, the shape of the products 14 to be dispensed by the dispenser 12 and the reduction of the speed and redirection of the products 14 achieved by the obstruction (discussed below).

An arcuate lower stop 82 may be positioned proximate the front end 72 of the lower support deck 68 to prevent products 14 from rolling beyond the front end 72 of the lower support deck 68. Therefore, the stop 82 may collect products 14 at the front end 72 of the lower support deck 68, thereby defining a first product display area 84 proximate the front end 72 of the lower support deck 68. The lower stop 82 allows the products 14 deposited onto the lower support deck 68 to come to rest gradually by slowing the speed of the products 14 and preventing the impact of an immediate stop, thus reducing the sound produced.

Figure 5:
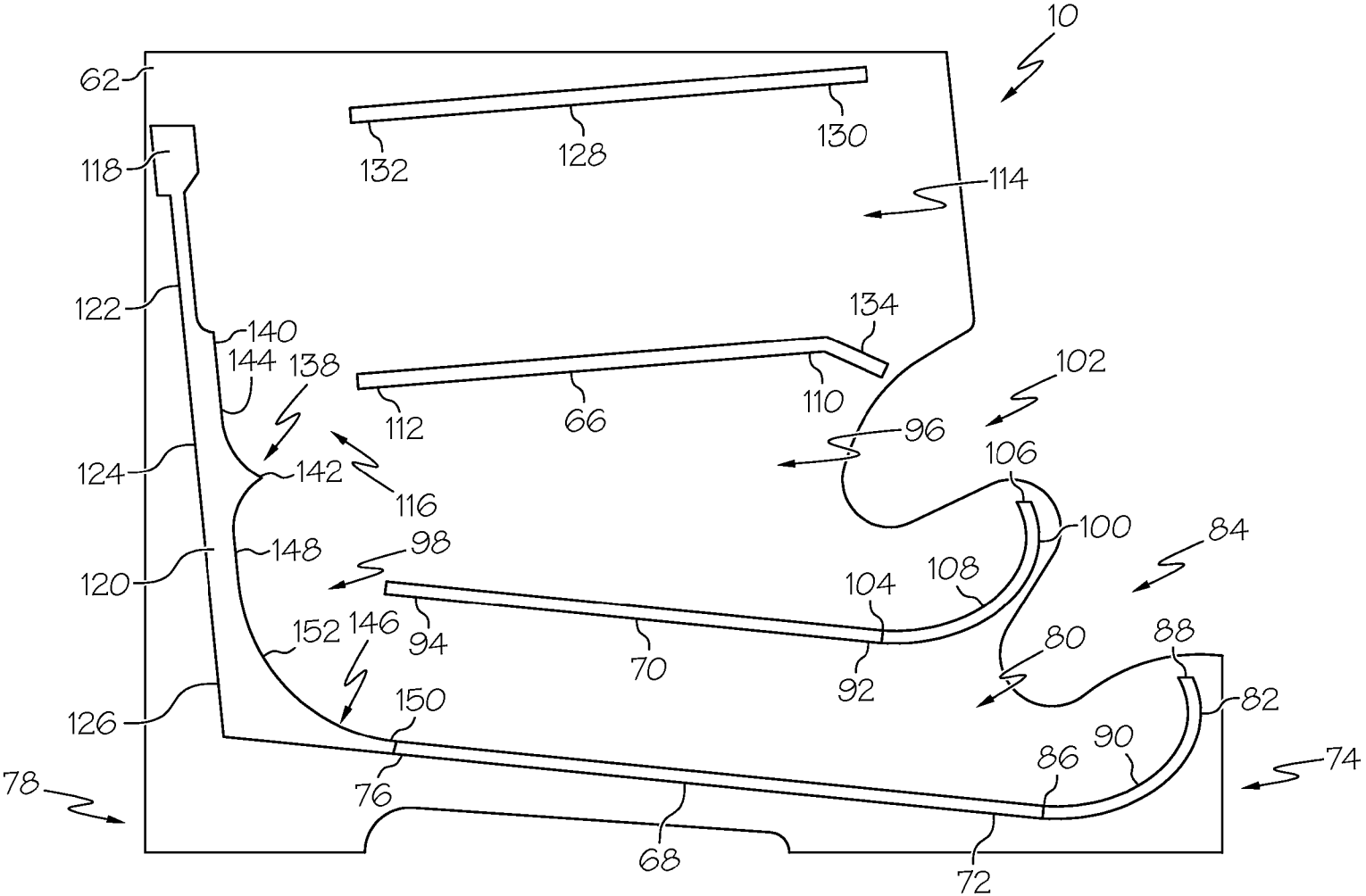
FIG. 5 is a side elevation view, in section, of the product dispensing system of FIG. 1.

The lower stop 82 may laterally extend between the right side wall 62 and the left side wall 64 of the frame 60. As shown in FIG. 5, the lower stop 82 may include a curve beginning 86 extending into the interior of the frame 60 proximate the front end 72 of the lower support deck 68 and a curve ending 88 extending toward the first product display area 84. A curved surface 90 of the lower stop 82 may include a radius larger than the curvature radius of the dispensed products 14, such that when a plurality of products 14 are deposited on the lower support deck 68, a forward most product 14A (FIG. 2) may be guided onto the curved surface 90 of the stop 82 by the force of a rearward plurality of products 14 (FIG. 2) in order to be positioned within the first product display area 84. The angles of the curve beginning 86 and curve ending 88, the radius of the curved surface 90 of the lower stop 82, and the degree of arc between the curve beginning 86 and curve ending 88 may be dictated by, among other things, the coefficient of friction and hardness of the material used to form the stop 82, the shape of the products 14 to be dispensed by the dispenser 12, the weight of the products 14, and the rigidity of the products 14.

Referring to FIGS. 2 and 5, as the forward most product 14A moves along the curved surface 90 of the stop 82, for example in response to the force applied by the rearward plurality of products 14, the product 14A may be vertically displaced relative the lower support deck 68 and a directly rearward product 14B. As the forward most product 14A moves further along the curved surface 90 of the stop 82, for example when the product 14A is being removed from the first product display area 84, a distance between the directly rearward product 14B and the stop 82 is reduced, thus reducing the speed the rearward product 14B can achieve before rolling up the lower stop 82 and further reducing the sound of the subsequent impact.

The intermediate support deck 70 may be positioned between the upper support deck 66 and the lower support deck 68. The intermediate support deck 70 may laterally extend between the right side wall 62 and left side wall 64 and may include a front end 92 that longitudinally extends toward the front end 74 of the frame 60 and a rear end 94 that longitudinally extends toward, but not to, the rear end 78 of the frame 60. Therefore, the intermediate support deck 70 and the side walls 62, 64 may define an intermediate level 96 of the frame 60.

The spacing between the rear end 94 of the intermediate support deck 70 and the rear end 78 of the frame 60 may define an intermediate opening 98, which may function as a channel to allow products 14 to move from the intermediate level 96 down to the lower level 80 of the frame 60 under the force of gravity.

The intermediate support deck 70 may be inclined from the front end 92 to the rear end 94 (i.e., the rear end 94 may be elevated relative to the front end 92) such that products 14 deposited proximate the rear end 94 of the intermediate support deck 70 roll down to the front end 92 of the intermediate support deck 70 under the force of gravity. The extent of the incline of the intermediate support deck 70 may be dictated by, among other things, the coefficient of friction of the material used to form the frame 60 and the shape of the products 14 to be dispensed by the dispenser 12.

An arcuate intermediate stop 100 may be positioned proximate the front end 92 of the intermediate support deck 70 to prevent products 14 from rolling beyond the front end 92 of the intermediate support deck 70. Therefore, the stop 100 may collect products 14 at the front end 92 of the intermediate support deck 70, thereby defining a second product display area 102 proximate the front end 92 of the intermediate support deck 70. The second product display area 102 may be longitudinally displaced (e.g., inwardly) relative to the first product display area 84. The second product display area 102 may be vertically displaced (e.g., upwardly) relative the first product display area 84. The intermediate stop 100 allows the products 14 deposited onto the intermediate support deck 66 to come to rest gradually by slowing the speed of the products 14 and preventing the impact of an immediate stop, thus reducing the sound produced.

The intermediate stop 100 may laterally extend between the right side wall 62 and the left side wall 64 of the frame 60. As shown in FIG. 5, the stop 100 may include a curve beginning 104 extending into the interior of the frame 60 proximate the front end 92 of the intermediate support deck 70 and a curve ending 106 extending toward the second product display area 102. A curved surface 108 of the intermediate stop 100 may include a radius larger than the curvature radius of the dispensed products 14, such that when a plurality of products 14 are deposited on the intermediate support deck 70, a forward most product 14C may be guided onto the curved surface 108 of the stop 100 by the force of a rearward plurality of products 14 in order to be positioned within the second product display area 102. The angles of the curve beginning 104 and curve ending 106, the radius of the curved surface 108 of the intermediate stop 100, and the degree of arc between the curve beginning 86 and curve ending 88 may be dictated by, among other things, the coefficient of friction of the material used to form the stop 100 and the shape of the products 14 to be dispensed by the dispenser 12.

Referring to FIGS. 2 and 5, as the forward most product 14C moves along the curved surface 108 of the stop 100, for example in response to the force applied by the rearward plurality of products 14, the product 14C may be slightly vertically displaced relative the intermediate support deck 70 and a directly rearward product 14D. As the forward most product 14C moves further along the curved surface 108 of the stop 100, for example when the product 14C is being removed from the second product display area 102, a distance between the directly rearward product 14D and the stop 100 is reduced, thus reducing the speed the rearward product 14D can achieve before impact with the stop 100 and further reducing the sound of the subsequent impact.

The upper support deck 66 may laterally extend between the right side wall 62 and left side wall 64 and may include a front end 110 that longitudinally extends toward the front end 74 of the frame 60 and a rear end 112 that longitudinally extends toward, but not to, the rear end 78 of the frame 60. Therefore, the upper support deck 66 and the side walls 62, 64 may define an upper level 114 of the frame 60.

The spacing between the rear end 112 of the upper support deck 66 and the rear end 78 of the frame 60 may define an upper opening 116, which may function as a channel to allow products 14 to move from the upper level 114 down to the intermediate level 96 and lower level 80 of the frame 60 under the force of gravity.

The upper support deck 66 may be declined from the front end 110 to the rear end 112 (i.e., the front end 110 may be elevated relative to the rear end 112). Therefore, products 14 supported on the upper support deck 66 may roll under the force of gravity down to the rear end 112 of the upper support deck 66, through the opening 116, to the lower level 80 and intermediate level 96 of the frame 60 and, ultimately, to the first and second product display areas 84, 102.

Optionally, a container stop 118 may be connected proximate the rear end 78 of the frame 60. The stop 118 may extend into the upper level 114 of the frame 60 to inhibit rearward horizontal movement of the container 13 along the upper support deck 66 beyond the stop 118. Alternatively, the stop 118 may laterally extend between the right side wall 62 and the left side wall 64 of the frame 60 proximate the upper level 114 of the frame 60 to inhibit rearward horizontal movement of the container 13 along the upper support deck 66 beyond the stop 118.

An obstruction, such as guide 120 discussed below, may be positioned to interfere with movement of products 14 through the channel defined by the intermediate opening 98 and the upper opening 116. For example, the obstruction may prevent a purely vertical drop through the channel. Therefore, as products 14 dropping through the channel interact with the obstruction, the obstruction may absorb some energy from the moving products 14 such that the products 14 ultimately contact the intermediate support deck 70 or the lower support deck 68 with less velocity, thereby making less sound.

Furthermore, the obstruction (e.g., guide 120) may reduce if not eliminate gaps between adjacent products 14 within the dispenser 12, thereby reducing if not eliminating the sound associate with product-to-product collisions within the dispenser The guide 120 may be connected proximate the rear end 78 of the frame 60. The guide 120 may extend from proximate the upper opening 116 in the upper level 114 defined by the upper support deck 66, down through the intermediate opening 98 in the intermediate level 96 defined by the intermediate support deck 70 and, ultimately, down to the lower level 80 proximate the rear end 76 of the lower support deck 68. The guide 120 may laterally extend between the right side wall 62 and the left side wall 64 of the frame 60 and may include an upper end 122 proximate the upper opening 116, a middle portion 124 proximate the intermediate opening 98, and a lower end 126 proximate the rear end 76 of the lower support deck 70. Alternatively, the upper end 122 of the guide 120 may extend to the container stop 118.

Thus, the guide 120 may receive products 14 exiting through the upper opening 50 in the container 13 and through the upper opening 116 and may guide the products 14 down through the intermediate opening 98 proximate the rear end 76 of the lower support deck 68, thereby allowing the products 14 guided to the lower level 80 to ultimately move to the first product display area 84. Once the lower level 80 of the frame 60 has been filled with products 14 such that the intermediate opening 98 in the intermediate level 96 is bridged by a bridging product 14E (FIG. 2), the guide 120 may guide the products 14 down proximate the rear end 94 of the intermediate support deck 70, thereby allowing the products 14 guided to the intermediate level 96 to ultimately move to the second product display area 102.

Optionally, a container retaining deck 128 may be positioned above and generally parallel to the upper support deck 66. The retaining deck 128 may laterally extend between the right side wall 62 and the left side wall 64 and may include a front end 130 that longitudinally extends toward the front end 74 of the frame 60 and a rear end 132 that longitudinally extend toward, but not to, the rear end 78 of the frame 60. The retaining deck 128 may make contact with the upper wall 28 of the container 13 when in position upon the upper support deck 66 (FIG. 2).

The front end 130 of the upper support deck 66 may include an access incline 134 to allow for smooth and unobstructed insertion of the container 13 into the upper level 114 upon the upper support deck 66. The incline 134 may be inclined from the front end 74 of the frame 60 toward the front end 130 of the upper support deck 66.

Figure 6:
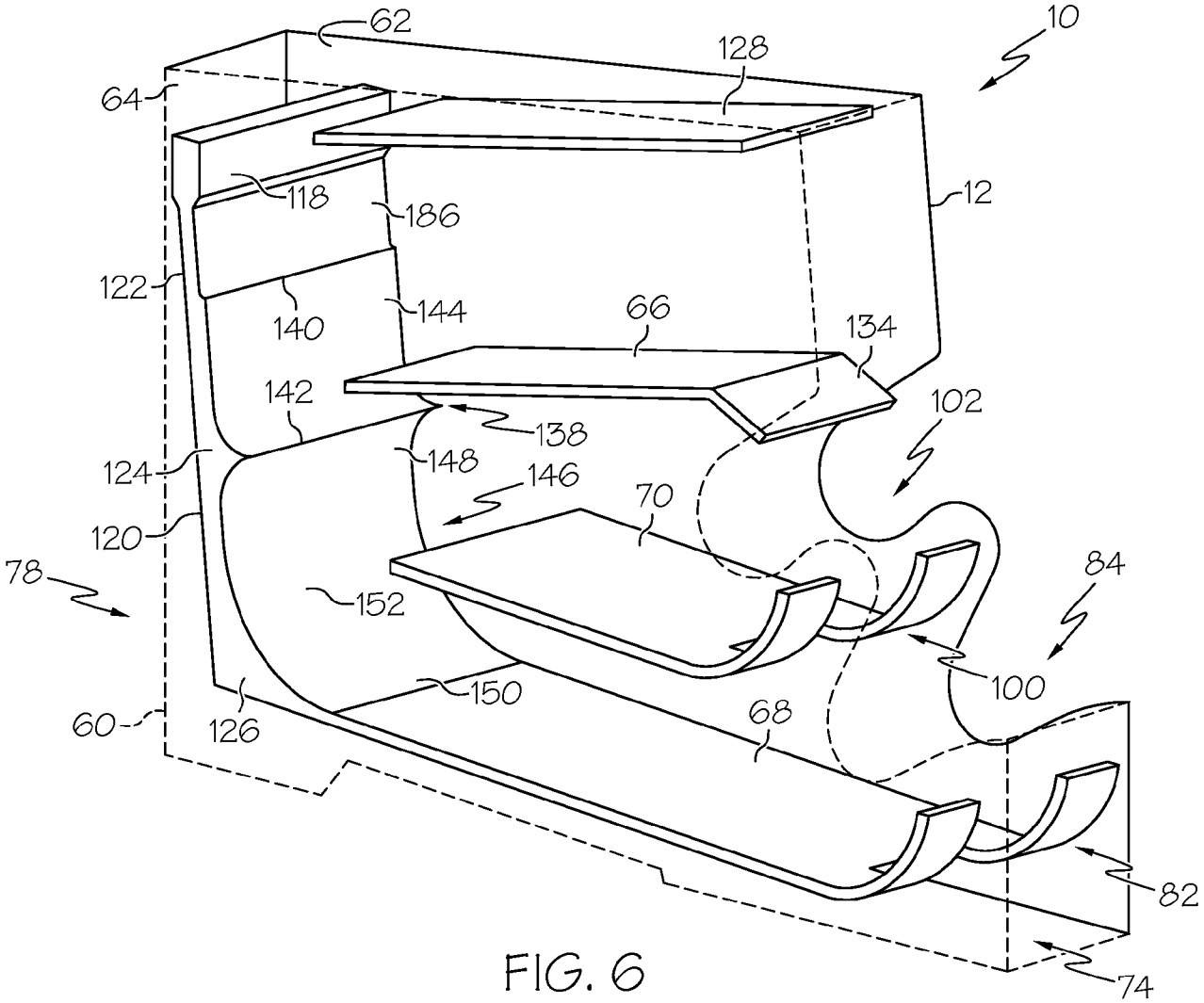
FIG. 6 is a transparent side perspective view of the product dispensing system of FIG. 1.

Referring next to FIGS. 2, 5 and 6, the guide 120 may include an interior surface 136 which faces the frame levels 80, 96, 114 to guide and support products 14 exiting through the upper opening 50 in the container 13 and through the upper opening 116 and down through the intermediate opening 98. The interior surface 136 of the guide 120 may include an upper ramp 138 proximate the middle portion 124 of the guide 120. The upper ramp 138 may include a curve beginning 140 adjacent the interior surface 136 of the guide 120 and a curve ending 142 extending outwardly toward the intermediate level 96. The upper ramp 138 may laterally extend between the right side wall 62 and the left side wall 64. The curve ending 142 may be longitudinally displaced (i.e., forwardly) relative the curve beginning 140 forming a downwardly inclined curved surface 144.

A curved surface 144 of the upper ramp 138 may include a radius larger than the curvature radius of the dispensed products 14, such that products 14 exiting the container opening 50 through the upper opening 116 are smoothly urged forward toward the intermediate level 96 and are rolled toward the intermediate support deck 70. The angles of the curve beginning 140 and curve ending 142, the radius of the curved surface 144 of the upper ramp 138, and the degree of arc between the curve beginning 140 and curve ending 142 may be dictated by, among other things, the coefficient of friction of the material used to form the guide 120 and the shape of the products 14 to be dispensed by the dispenser 12.

The interior surface 136 of the guide 120 may include a lower ramp 146 proximate the lower end 126 of the guide 120. The lower ramp 146 may include a curve beginning 148 adjacent the interior surface 136 of the guide 120 and a curve ending 150 extending outwardly proximate the rear end 76 of the lower support deck 70. The lower ramp 146 may laterally extend between the right side wall 62 and the left side wall 64. The curve beginning 148 may be longitudinally displaced (rearwardly) relative the curve ending 142 of the upper ramp 138. The curve ending 150 may be longitudinally displaced (i.e., forwardly) relative the curve beginning 148 forming a downwardly inclined curved surface 152.

A curved surface 152 of the lower ramp 146 may include a radius larger than the curvature radius of the dispensed products 14, such that products 14 exiting the container opening 50 through the upper opening 116 and down through the intermediate opening 98 are smoothly urged forward toward the lower level 80 and deposited on the lower support deck 68. The angles of the curve beginning 148 and curve ending 150, the radius of the curved surface 152 of the lower ramp 146, and the degree of arc between the curve beginning 148 and curve ending 150 may be dictated by, among other things, the coefficient of friction of the material used to form the guide 120 and the shape of the products 14 to be dispensed by the dispenser 12.

Figure 7:
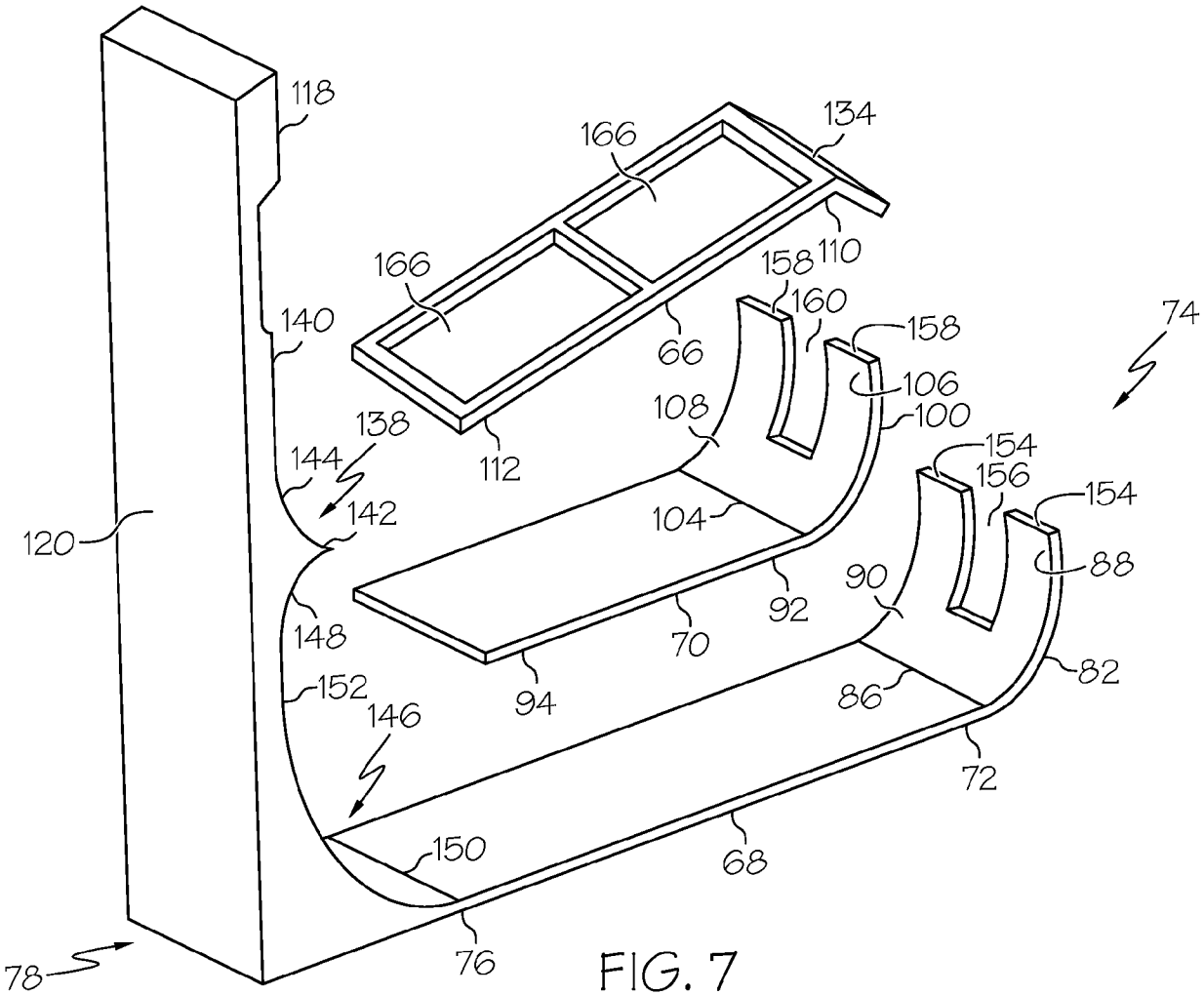
FIG. 7 is a side perspective view of the product dispensing system of FIG. 1.

Referring next to FIG. 7, depicting the product dispensing system 10 with the left side wall 62, right side wall 64, and optional retaining deck 128 removed for clarity. The lower stop 82 may include a pair of curved guide members 154. The guide members 154 may be positioned parallel to each other and extend proximate from the curve beginning 86 to the curve ending 88 and may define the curved surface 90 of the lower stop 82. An open area 156 may be disposed between the guide members 154 to allow for access of product 14A from the front when being removed from the first product display area 84. The guide members 154 and open area 156 may allow for smooth and unimpeded movement of products 14 having a non-uniform circumference along the curved surface 90 and removal from the first product display area 84.

The intermediate stop 100 may include a pair of curved guide members 158. The guide members 158 may be positioned parallel to each other and extend proximate from the curve beginning 104 to the curve ending 106 and may define the curved surface 108 of the intermediate stop 100. An open area 160 may be disposed between the guide members 154 to allow for access of product 14C from the front when being removed from the first product display area 84. The guide members 158 and open area 160 may allow for smooth and unimpeded movement of products 14 having a non-uniform circumference along the curved surface 108 and removal from the second product display area 102.

Figure 8:
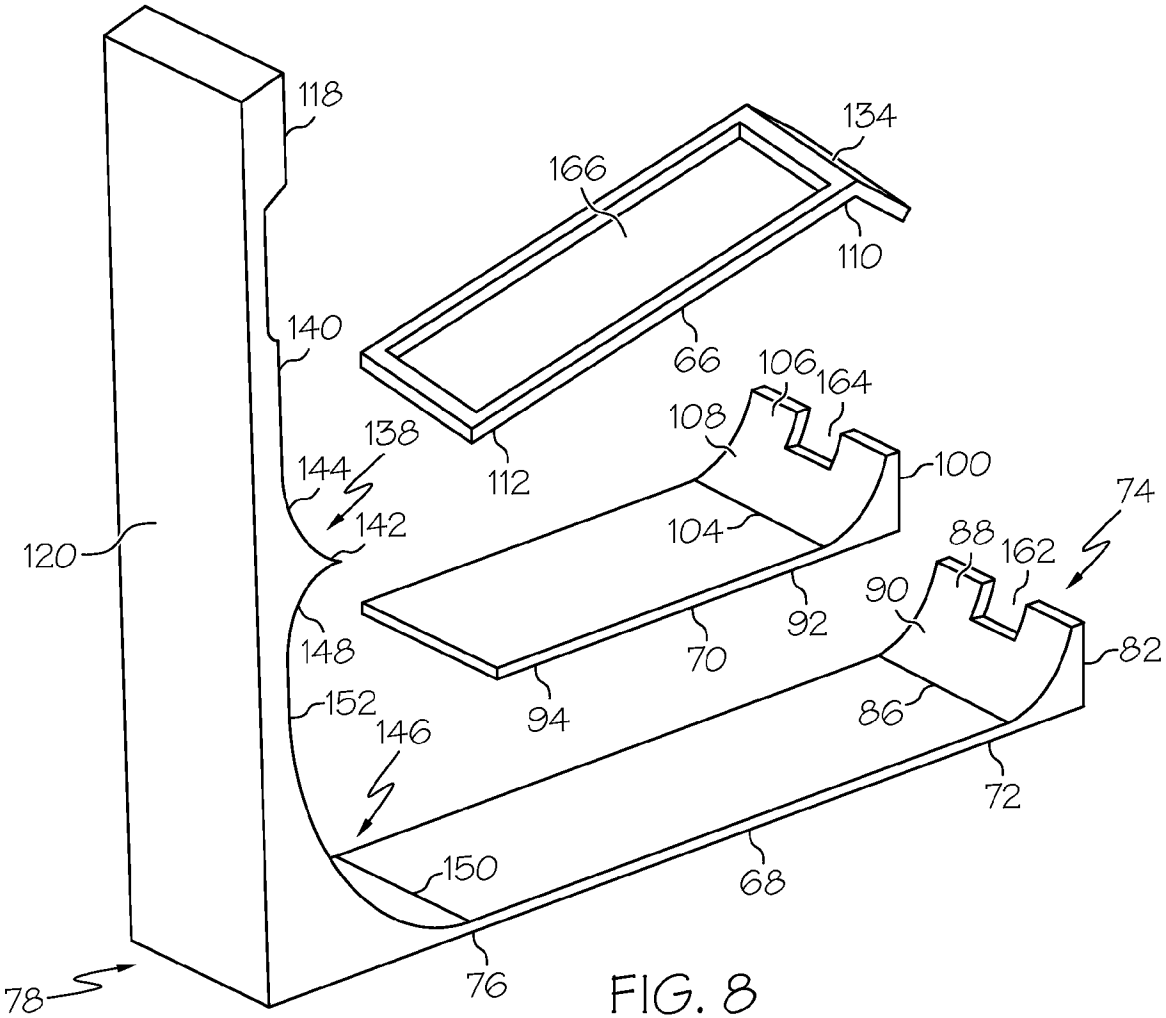
FIG. 8 is a side perspective view of another embodiment of the disclosed product dispensing system with sound reducing features.

Referring next to FIG. 8, depicting another embodiment of the product dispensing system 10 with the left side wall 62, right side wall 64, and optional retaining deck 128 removed for clarity. The lower stop 82 may include a central cut-out 162 proximate the curve ending 88. The cut-out 162 may extend through the curved surface 90 toward, but to, the curve beginning 86. The cut-out 162 may allow for access of product 14C from the front when being removed from the first product display area 84. The intermediate stop 100 may include a central cut-out 164 proximate the curve ending 106. The cut-out 164 may extend through the curved surface 108 toward, but to, the curve beginning 104. The cut-out 164 may allow for access of product 14C from the front when being removed from the second product display area 102.

Figure 9:
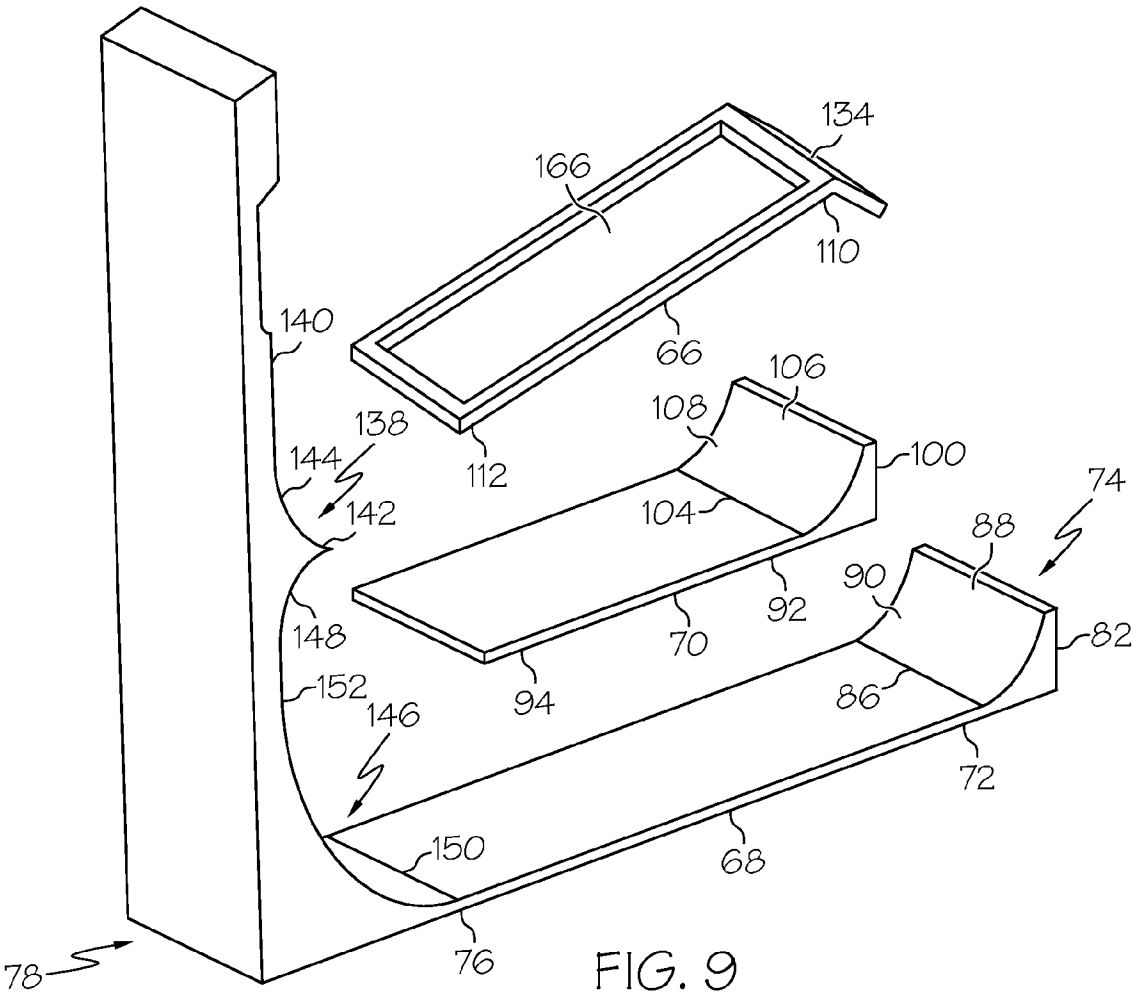
FIG. 9 is a side perspective view of another embodiment of the disclosed product dispensing system with sound reducing features.

Referring next to FIG. 9, depicting another embodiment of the product dispensing system 10 with the left side wall 62, right side wall 64, and optional retaining deck 128 removed for clarity. The lower stop 82 may include a continuous curved surface 90 extending from the curve beginning 86 to the curve ending 88. The intermediate stop 100 may include a continuous curved surface 108 extending from the curve beginning 86 to the curve ending 88.

Optionally, the upper support deck 68 may include at least one cored-out open region 166 between the front end 110 and the rear end 112. The open region 164 may extend from proximate the right side wall 62 to proximate the left side wall 64. As depicted in FIG. 7, the upper support deck may 66 include more than one open region 166 disposed longitudinally through the upper support deck 66 proximate the front end 110 and the rear end 112. Alternatively, as depicted in FIG. 8, the upper support deck may include one elongated open region 166 disposed longitudinally from proximate the front end 110 to proximate the rear end 112. The open region 166 of the upper support deck 66 may further reduces the noise from upper level products 14 within the container 13 falling and impacting a rigid continuous surface of the upper support deck 66 as lower level products 14 exit the container 13 through the opening 50. In such a manner, the upper level products 14 may instead impact the base wall 26 of the container 13 as opposed to a solid, rigid surface of the support deck 66.

The upper support deck 68 may have a nominal surface area (e.g., the overall length of the upper support deck 68 multiplied by the lateral width of the upper support deck 68). In one construction, the open region 166 may be at least 25 percent of the nominal surface area of the upper support deck 68. In another construction, the open region 166 may be at least 50 percent of the nominal surface area of the upper support deck 68. In yet another construction, the open region 166 may be at least 75 percent of the nominal surface area of the upper support deck 68.

Another embodiment of the disclosed dispenser system 10 may include a dispenser having one or more opening tools (not shown). The opening tools may be positioned in the upper level 114 of the frame 60 to automatically form an opening in the container 13 as the container 13 is loaded onto the frame 60, thereby releasing products 14 from the container into the dispenser 12. The type of opening tools used as well and the position of the opening tools relative to the frame 60 may depend upon the configuration of the container, among other things. As one example, the opening tool may include one or more cutting elements that inwardly protrude from the side walls 62, 64 proximate the rear end 112 of the upper support deck 66 to sever a plurality of severance lines disposed on certain styles of containers to release an access door, as described in U.S. Ser. No. 13/184,639 filed on Jul. 18, 2011, the entire contents of which are incorporated herein by reference. As another example, the opening tool may include a cutting element positioned to form access panels in the container that open laterally outward, as described in U.S. Patent No. 7,922,437 (discussed above). As another example, the opening tool may include a forward-protruding catch element, such as the forward-protruding catch element disclosed in U.S. Ser. No. 12/891,391 filed on Sep. 27, 2010, the entire contents of which are incorporated herein by reference, or the forward-protruding catch element disclosed in U.S. Ser. No. 13/032,734 filed on Feb. 23, 2011, the entire contents of which are incorporated herein by reference. As yet another example, the opening tool may include a rear-protruding catch element, such as the rear-protruding catch element disclosed in U.S. Ser. No. 12/970,683 filed on Dec. 16, 2010, the entire contents of which are incorporated herein by reference.

The product dispensing system 10 may be assembled by opening the container 13 (e.g., tearing away the removable opening feature 36 at the severance lines 38, 40, 42, 46, 48) and urging the opened container 13 along the upper support deck 66 of the frame 60 until the rear wall 20 of the container 13 comes into abutting engagement with the stop 118. With the opened container 13 loaded onto the dispenser 12, the force of gravity may urge the products 14 housed in the container 13 through the opening 50 in the container 13, down through the opening 116 in the upper level 114 of the frame 60 and, ultimately, to the first and second product display areas 84, 102.

Figure 10A:
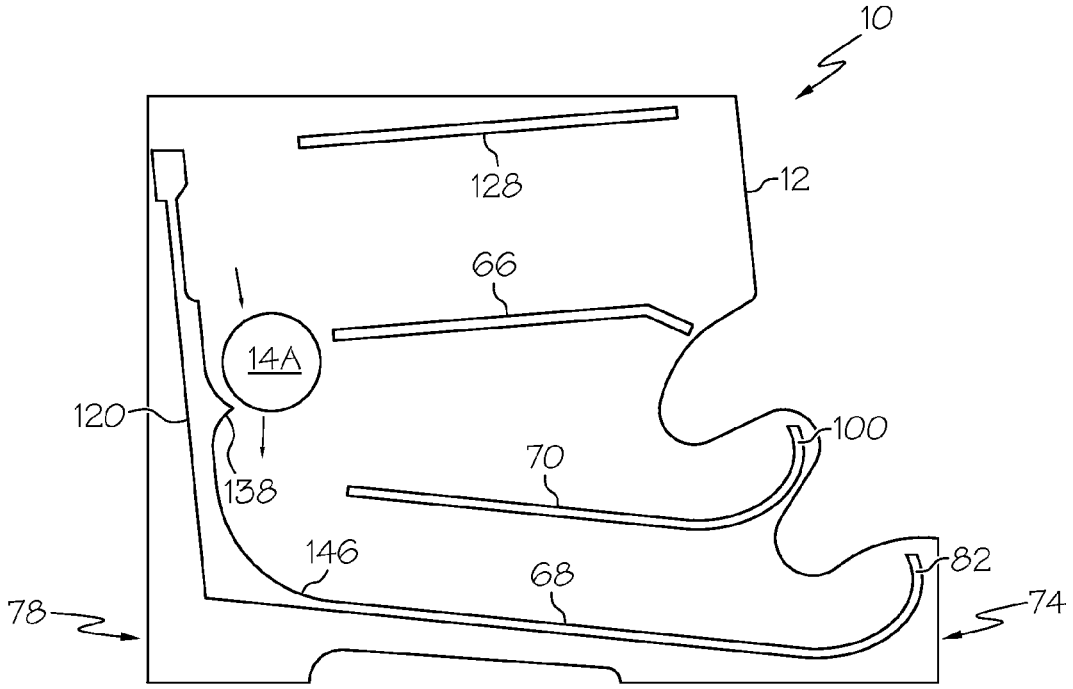
FIGS. 10*a* through 10*n* are schematic views of the operation of the disclosed product dispensing system with sound reducing features.
Figure 10B:
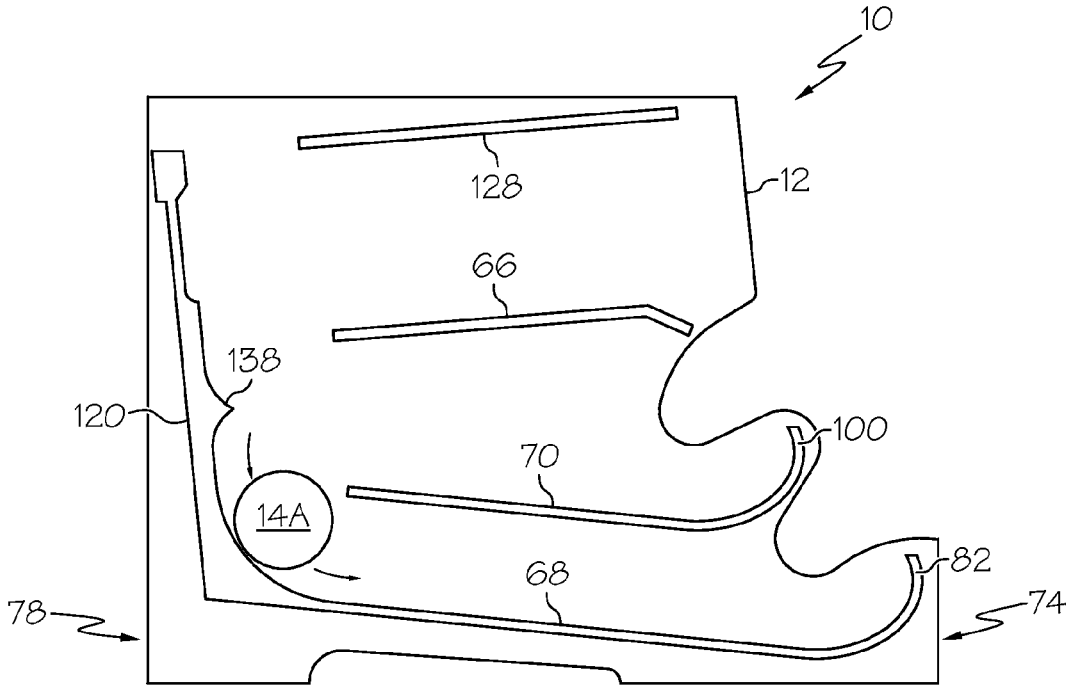
Figure 10C:
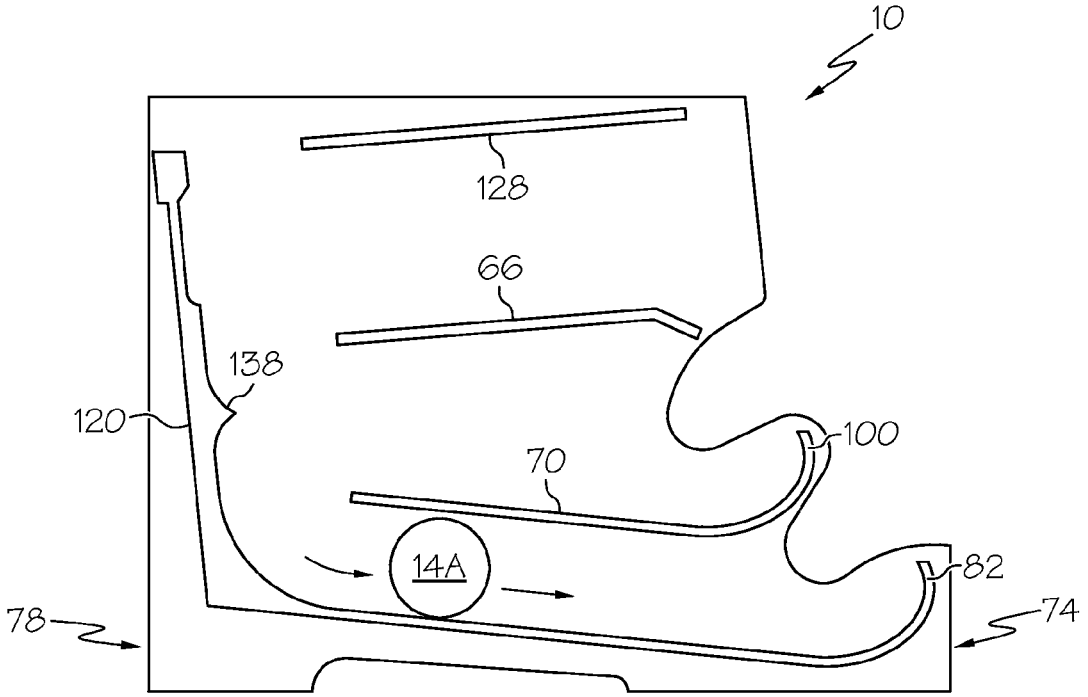
Figure 10D:
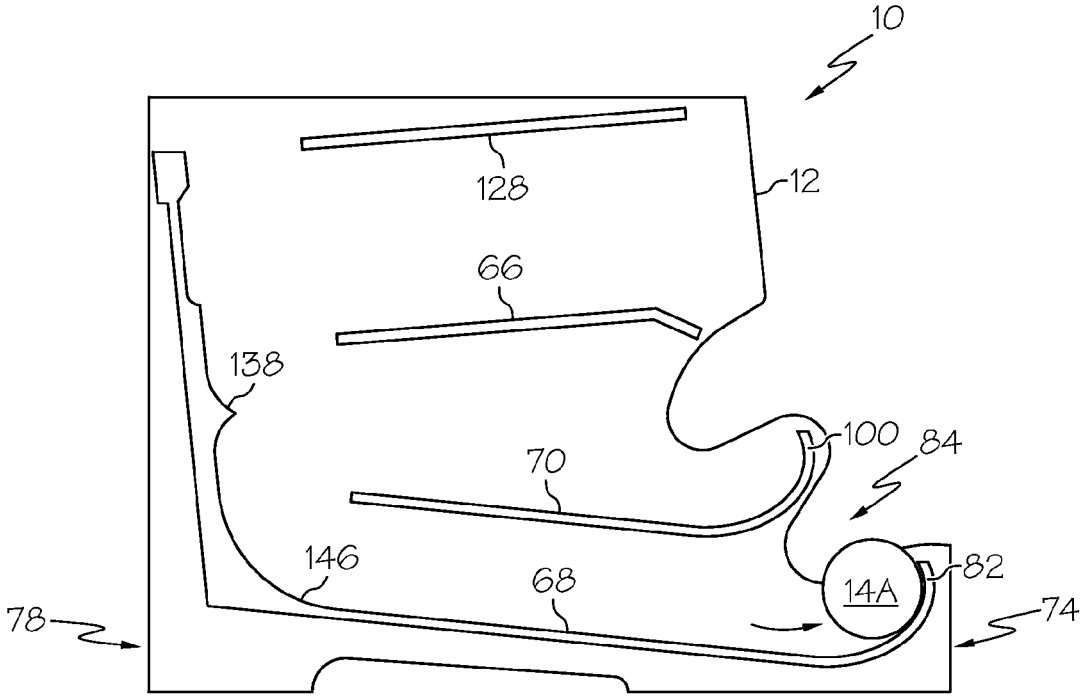
Figure 10E:
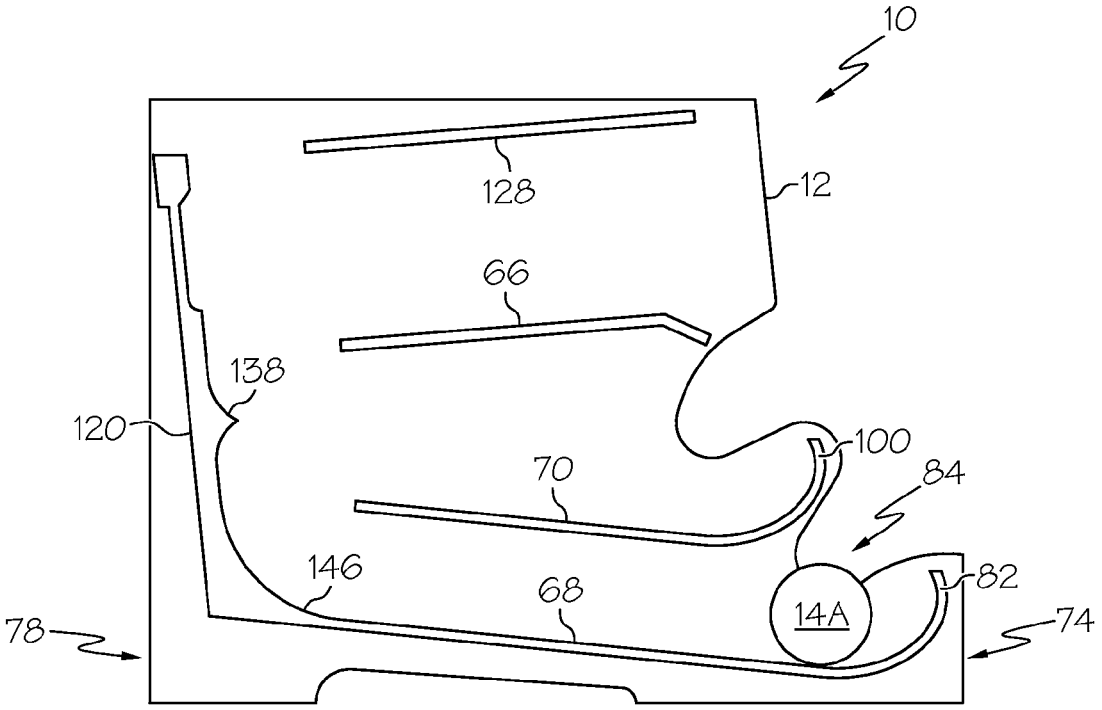
Figure 10F:
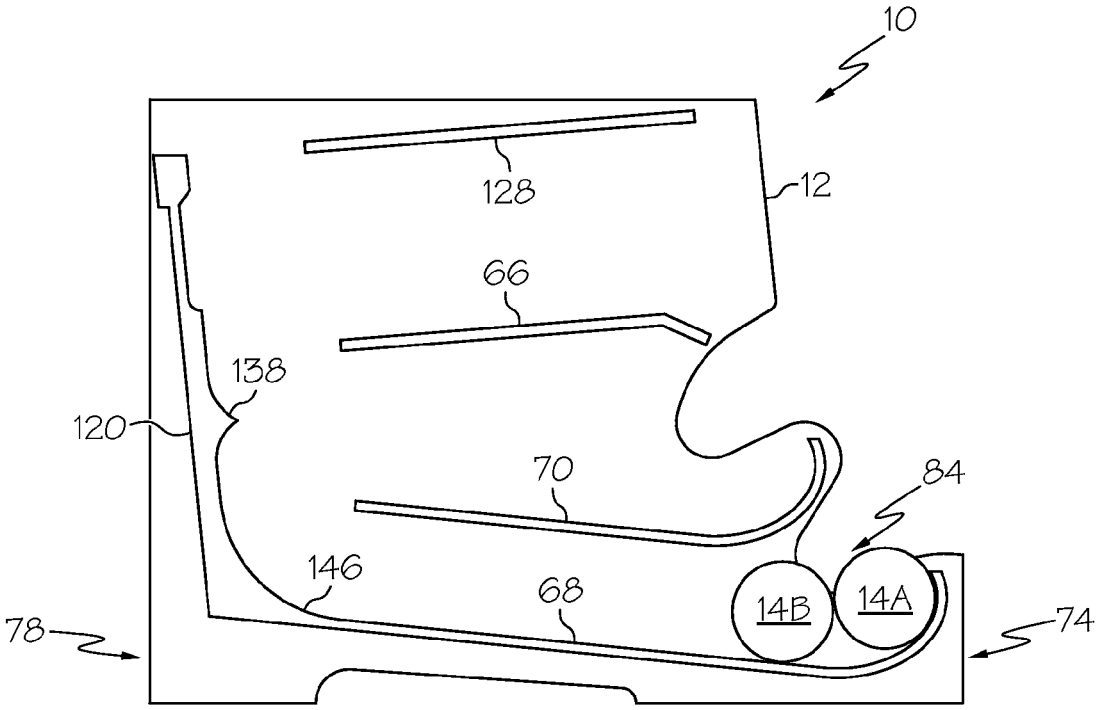

Referring next to FIGS. 10*a* through 10*g*, depicting a schematic view of the progression of products 14 through the opening 50 in the container 13, through the upper opening 116 in the upper level 114, and down through the intermediate opening 98 in the intermediate level 96 and guided by the guide 120 for deposit on the lower support deck 68. As the first product 14A exits the container 13, it drops through the upper opening 116 and contacts the curved surface 144 of the upper ramp 138 (FIG. 10*a*), which decreases the distance the product 14A travels and slows the speed of the product 14A. The product 14A then rolls off of the curve ending 142 of the upper ramp 138 and drops through the intermediate opening 98 and contacts the curved surface 152 of the lower ramp 146 (FIG. 10*b*), which further slows the speed of the product 14A. The product 14A then rolls off of the curve ending 150 of the lower ramp 146 and is deposited onto the lower support deck 68, where the product 14A rolls from the rear end 76 to the front end 72 of the lower support deck 70 (FIG. 10*c*). The product 14A comes to a stop at the lower stop 82, where it may partially roll up the curved surface 90 of the lower stop 82 further slowing the speed of the product 14A (FIG. 10*d*) until it comes naturally to rest proximate the curve beginning 86 of the lower stop 82 at the first product display area 84 (FIG. 10*e*).

Figure 10G:
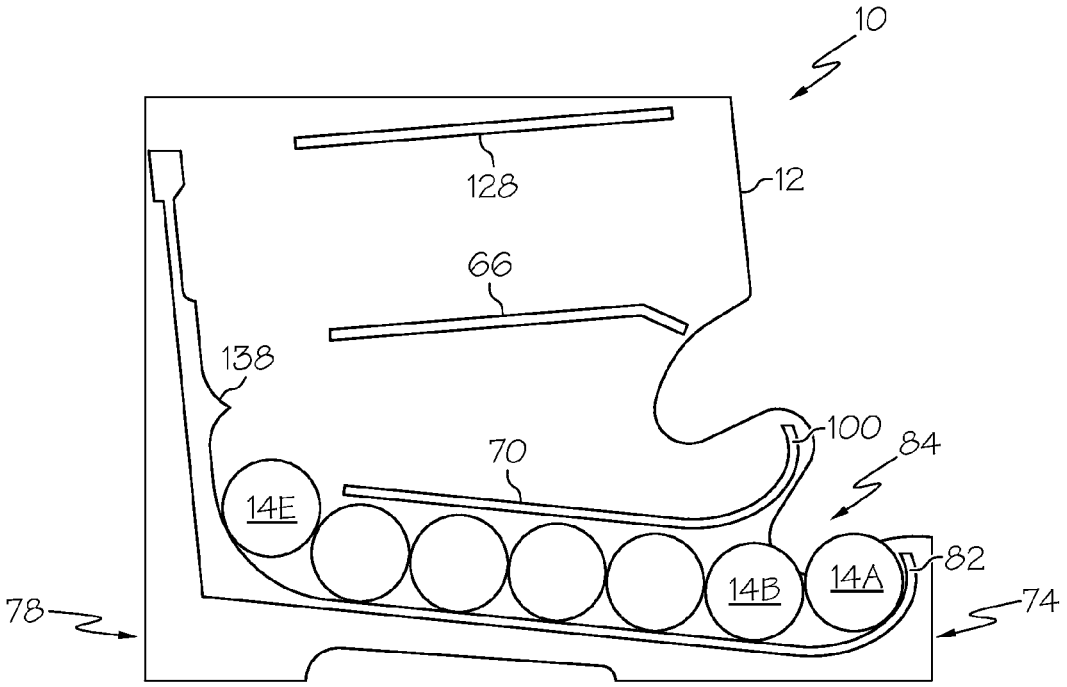
Figure 10H:
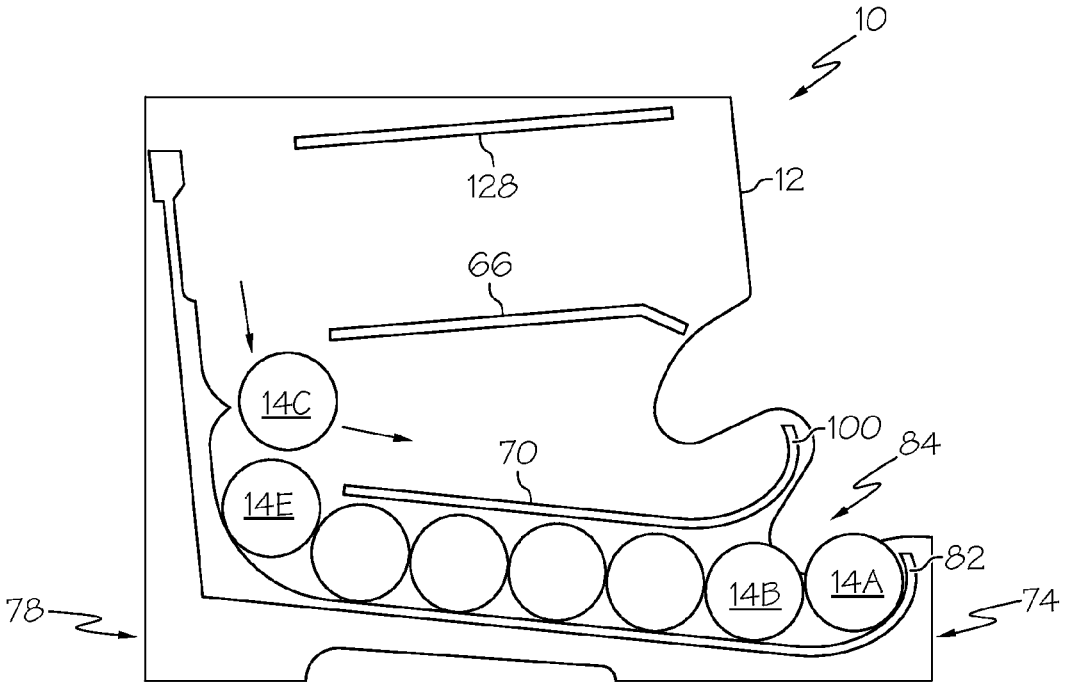
Figure 10I:
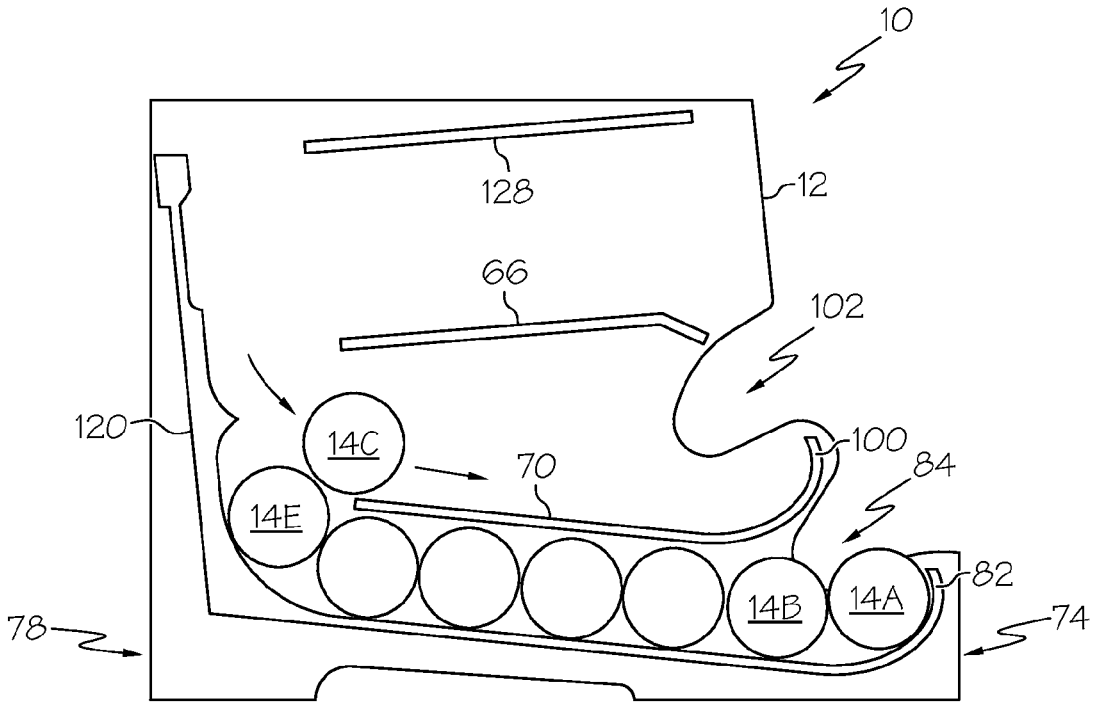

Subsequent products 14 follow the path of the first product 14A when deposited on the lower support deck 68 and come to rest behind the first product 14A. As a second product 14B approaches the front end 72 of the lower support deck 68, it impacts the first product 14A. The first product 14A absorbs this impact as it is pushed partially up the curved surface 90 of the lower stop 82 (FIG. 10*f*) until the first and second products 14A, 14B come naturally to rest upon the lower support deck 68. Additional products 14 are sequentially dispensed from the container 13 to fill the lower support deck 68 from the front end 72 to the rear end 76 until the bridging product 14E fills the intermediate opening 98 (FIG. 10*g*).

Figure 10J:
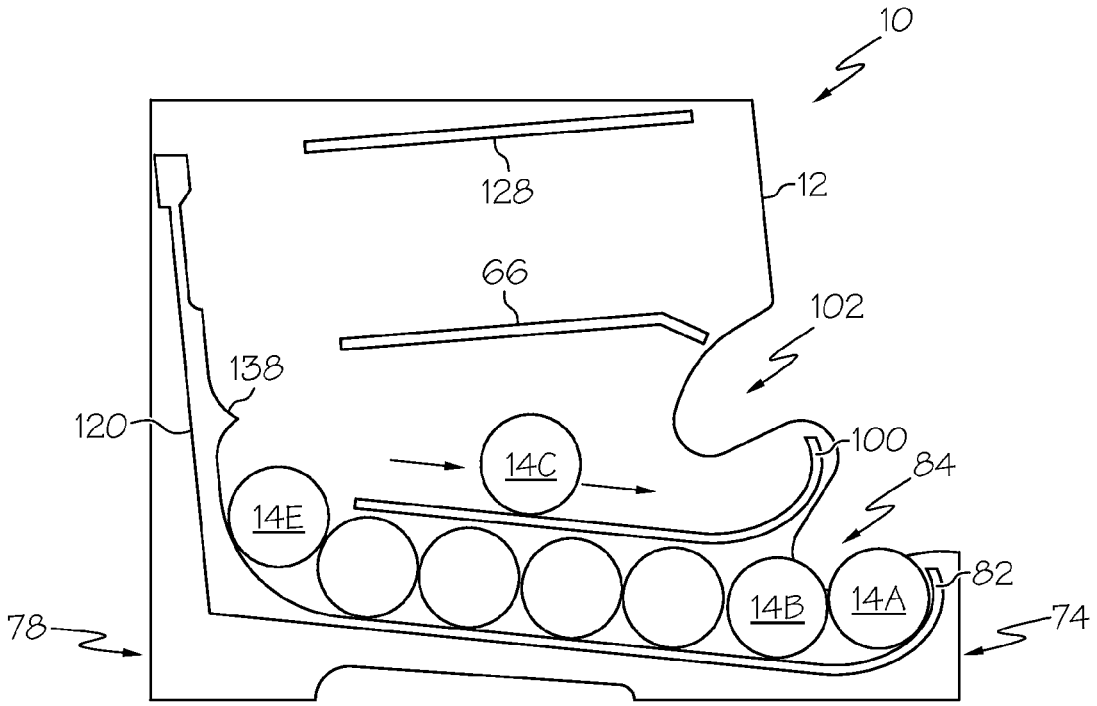
Figure 10K:
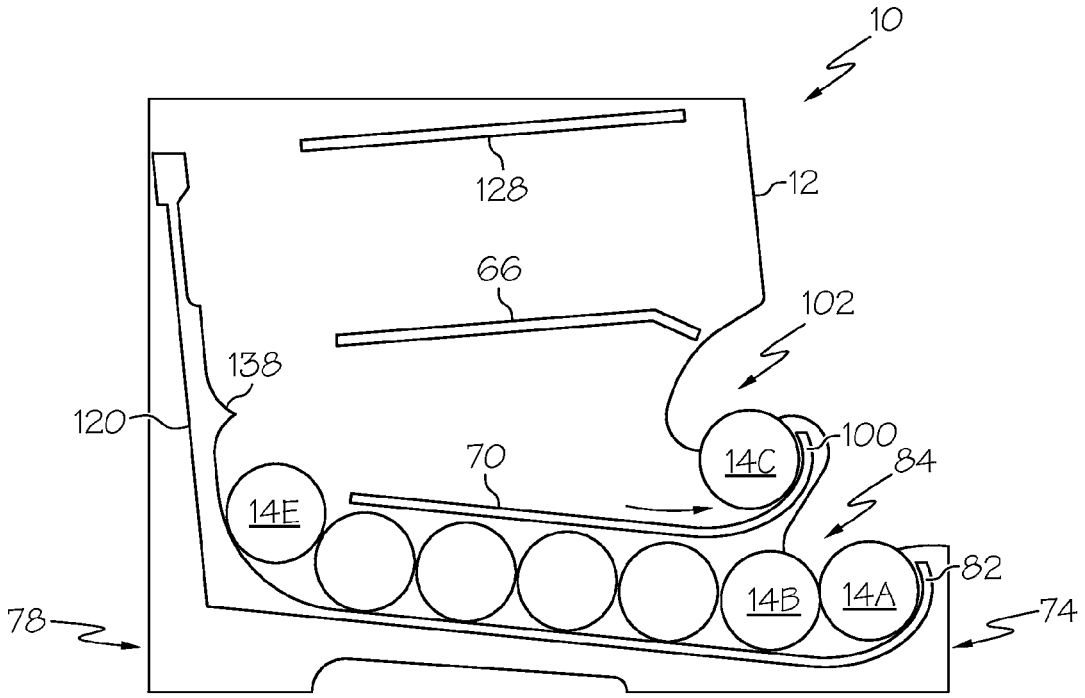
Figure 10L:
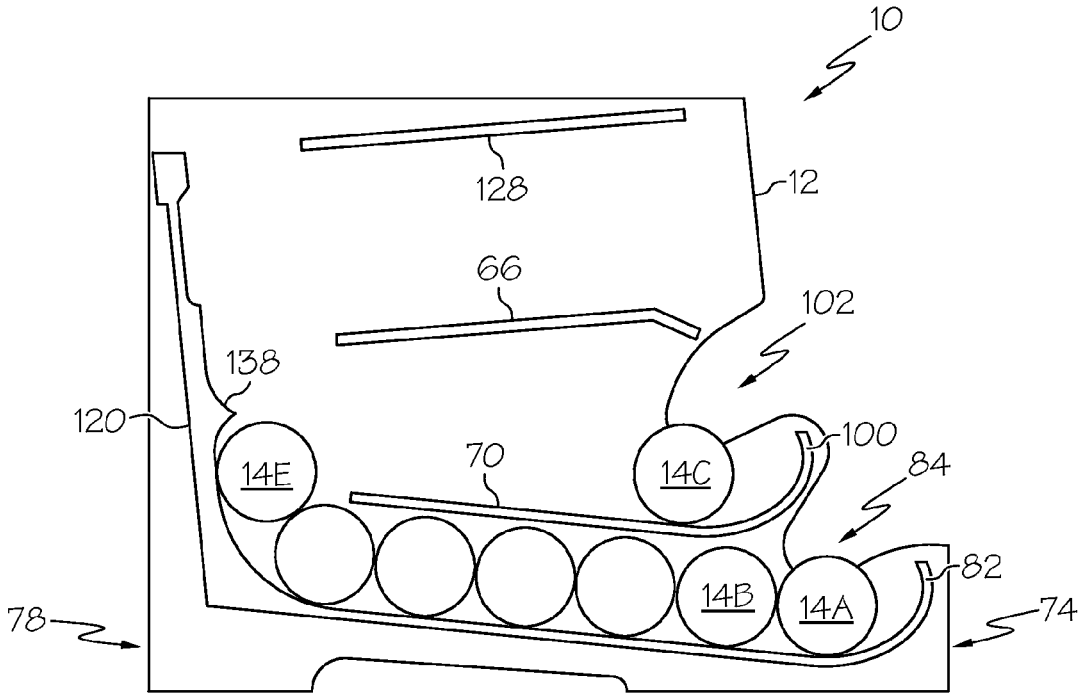
Figure 10M:
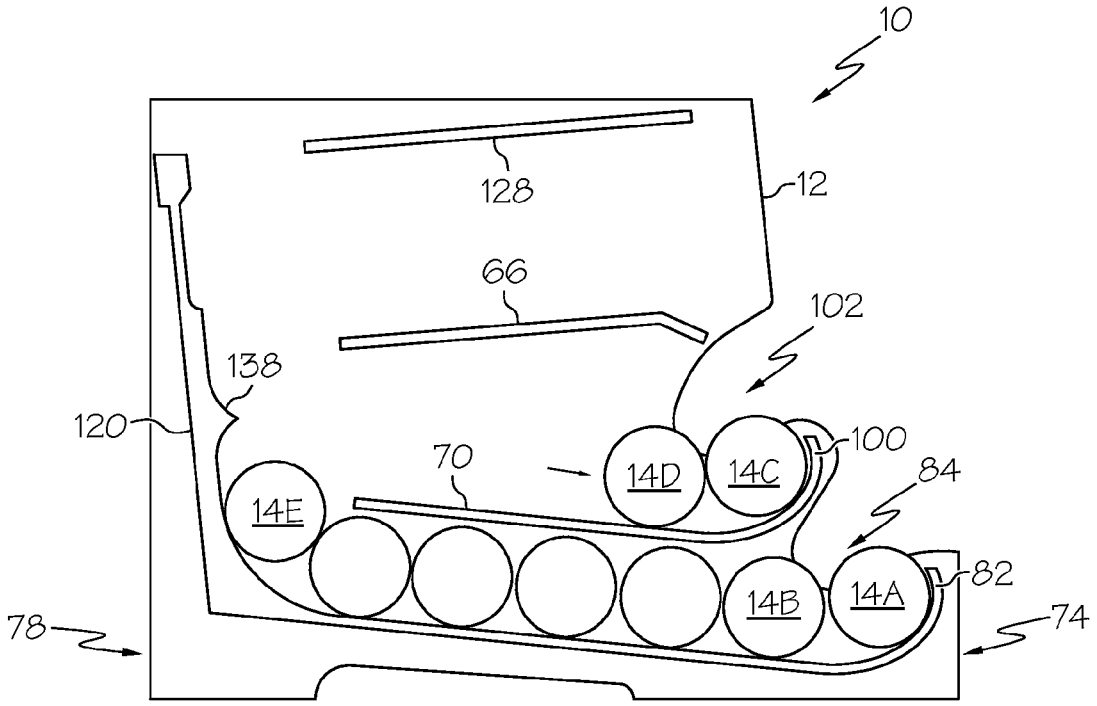

Referring finally to FIGS. 10*h* through 10*n*, depicting a schematic view of the progression of products 14 through the opening 50 in the container 13 and through the upper opening 116 in the upper level 114 and guided by the guide 120 for deposit on the intermediate support deck 70. After the bridging product 14E positioned, subsequent products 14 exit the opening 50 in the container 13 and drop through the upper opening 116. A first product 14C contacts the curved surface 144 of the upper ramp 138 (FIG. 10*h*), which decreased the distance the product 14C travels, slows the speed of the product 14C, and urges the product 14C toward the bridging product 14E. The product 14C then rolls off of the curve ending 142 of the upper ramp 138, passes over the bridging product 14E, and is deposited upon the intermediate support deck 70 (FIG. 10*i*), where the product 14C rolls from the rear end 112 to the front end 92 of the intermediate support deck 70 (FIG. 10*j*). The product 14C comes to a stop at the intermediate stop 100, where it may partially roll up the curved surface 108 of the intermediate stop 100 further slowing the speed of the product 14C (FIG. 10*k*) until it comes naturally to rest proximate the curve beginning 104 of the intermediate stop 100 at the second product display area 102 (FIG. 101).

Figure 10N:
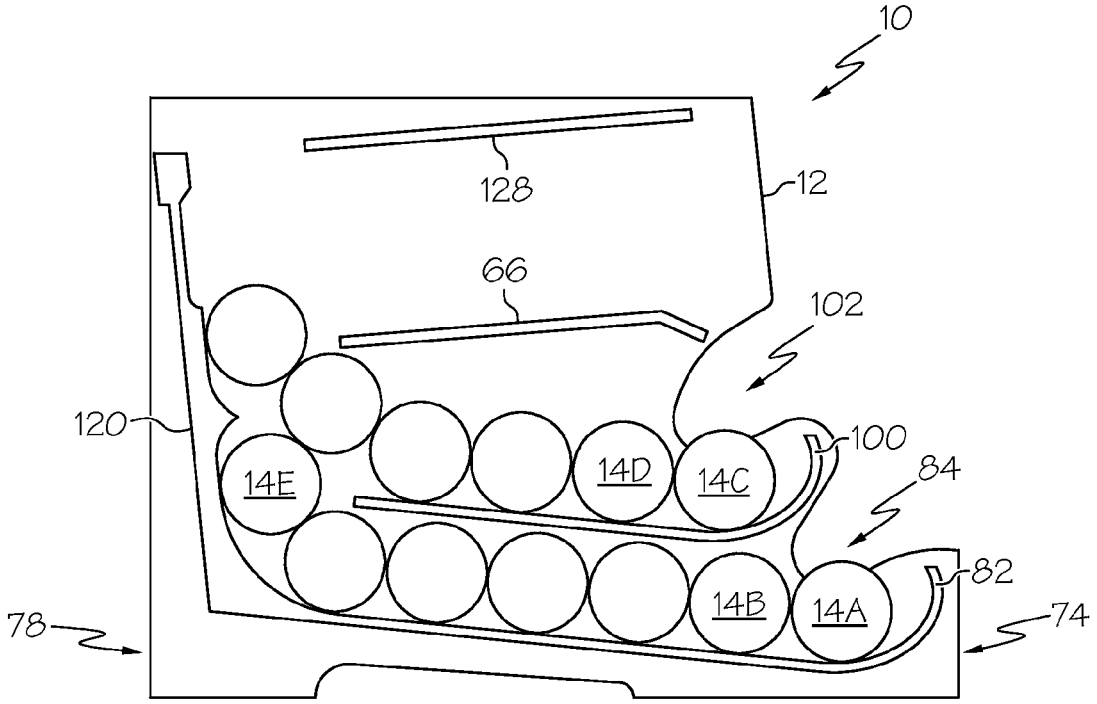

Subsequent products 14 follow the path of the first product 14C when deposited on the intermediate support deck 70 and come to rest behind the first product 14C. As a second product 14D approaches the front end 92 of the intermediate support deck 70, it impacts the first product 14C. The first product 14C absorbs this impact as it is pushed partially up the curved surface 108 of the intermediate stop 100 (FIG. 10*m*) until the first and second products 14C, 14D come naturally to rest upon the intermediate support deck 70. Additional products 14 are sequentially dispensed from the container 13 to fill the intermediate support deck 68 in a like manner from the front end 92 to the rear end 94 (FIG. 10*n*)

When a forward most product 14 is removed from a respective product display area 84, 102 of a stocked dispenser 12, the rearward plurality of products 14 roll down the respective support deck 68, 70 under the force of gravity, such that the immediately rearward product 14 is positioned within the respective product display area 84, 102 then becoming a replacement forward most product 14. As the rearward plurality of products 14 act upon the replacement forward most product 14, a respective stop 82, 100 allows the replacement forward most product 14 to slightly roll up the curved surface 90, 108 in order to slow down and come to a natural stop within the product display area 84, 102. The ramps 138, 146 and the stop 82, 100 sequentially absorb the energy and slow the speed of the products 14 as they pass through the dispenser 12 in route to the first and second product display areas 84,102, thus reducing the impact forces between adjacent products 14 and between products 14 and structural components of the dispenser frame 60. Accordingly, the sound produced by such reduced impact forces between surfaces of the products 14 and the frame 60 are substantially reduced.

Accordingly, the disclosed product dispensing systems employ multiple curved guides, ramps, and stops, thereby reducing (if not eliminating) gaps between adjacent products and slowing the speed at which products come into contact with the dispenser frame. Furthermore, the disclosed product dispensing systems may reduce the force of any internal impacts between products and the frame of the dispenser, as well as impacts between adjacent products within the dispenser, thus reducing the sound produced by the impacts.

Although various embodiments of the disclosed product dispensing system with sound reducing features have been shown and described, modifications may occur to those skilled in the art upon reading the specification. The present application includes such modifications and is limited only by the scope of the claims.

What is claimed is:

1. A product dispensing system comprising:

a dispenser frame having a front end and a rear end, said dispenser frame comprising:

an upper support deck extending between said front end and said rear end, the upper support deck having a upper support deck front end and an upper support deck rear end, with at least one open region between the upper support deck front end and upper support deck rear end;

a lower support deck positioned below said upper support deck, said lower support deck extending between said front end and said rear end and defining a product display area, wherein said dispenser frame defines a channel extending from said upper support deck rear end down to said lower support deck; and an obstruction extending into said channel to interact with products moving through said channel down to said lower support deck, the obstruction comprising a guide having an upper ramp having a first curved forward surface;

a lower ramp having a second curved forward surface;

the upper ramp and lower ramp intersecting at a forward-protruding curve end located at the lower end of the upper ramp and the upper end of the lower ramp.

2. The product dispensing system of claim 1 wherein said interaction between said obstruction and said products is sufficient to reduce a velocity of said products prior to said products contacting said lower support deck.

3. The product dispensing system of claim 1 wherein said obstruction comprises said guide extending from proximate said upper support deck to proximate said lower support deck, said guide being positioned proximate said rear end of said dispenser frame.

4. The product dispensing system of claim 3 wherein said guide comprises a downwardly inclined surface extending proximate said lower support deck.

5. The product dispensing system of claim 1 further comprising an arcuate stop positioned proximate said product display area.

6. The product dispensing system of claim 5 wherein said stop is curved upward toward said upper support deck.

7. The product dispensing system of claim 5 wherein said stop comprises a curved surface defined by a curve beginning and a curve ending, wherein said curve beginning extends toward said rear end.

8. The product dispensing system of claim 1 wherein said upper support deck has a nominal surface area, and wherein said open region comprising at least 25 percent of said nominal surface area.

9. The product dispensing system of claim 8 wherein said open region comprises at least 50 percent of said nominal surface area.

10. The product dispensing system of claim 1 further comprising:

a container on said upper support deck; and a plurality of products initially housed in said container;

wherein at least one of said plurality of products is positioned in said product display area.

11. A product dispensing system comprising:

a dispenser frame having a front end and a rear end, said dispenser frame comprising:

an upper support deck extending between said front end and said rear end, the upper support deck having a upper support deck front end and an upper support deck rear end, with at least one open region between the upper support deck front end and upper support deck rear end;

a lower support deck positioned below said upper support deck, said lower support deck extending between said front end and said rear end and defining a first product display area;

at least one intermediate support deck positioned between said upper support deck and said lower support deck, said intermediate support deck defining a second product display area, wherein said dispenser frame defines a channel extending from said upper support deck down to said lower support deck; and an obstruction extending into said channel to interact with products moving through said channel from said upper support deck down to one of said intermediate support deck and said lower support deck;

wherein the obstruction comprises a guide having an upper ramp having a first curved forward surface;

a lower ramp having a second curved forward surface;

the upper ramp and lower ramp intersecting at a forward-protruding curve end located at the lower end of the upper ramp and the upper end of the lower ramp.

12. The product dispensing system of claim 11 wherein said interaction between said obstruction and said products is sufficient to reduce a velocity of said products prior to said products contacting one of said intermediate support deck and said lower support deck.

13. The product dispensing system of claim 11 wherein said obstruction comprises said guide positioned proximate said rear end of said dispenser frame.

14. The product dispensing system of claim 13 wherein said guide comprises an upper end, a middle portion, and a lower end, wherein said upper ramp is positioned proximate said middle portion; and, said lower ramp is positioned proximate said lower end.

15. The product dispensing system of claim 14 wherein said upper ramp comprises a downwardly inclined curve surface defined by a curve beginning extending proximate said upper end of said guide and a curve ending extending between proximate said upper support deck and proximate said intermediate support deck.

16. The product dispensing system of claim 14 wherein said lower ramp comprises a downwardly inclined curve surface defined by a curve beginning extending proximate said upper ramp and a curve ending extending proximate said lower support deck.

17. The product dispensing system of claim 11 further comprising a first arcuate stop positioned proximate said first product display area and a second arcuate stop positioned proximate said second product display area.

18. The product dispensing system of claim 11 wherein said upper support deck has a nominal surface area, and wherein said open region comprises at least 50 percent of said nominal surface area.

19. A method for dispensing a plurality of product initially provided in a container, said method comprising the steps of:

providing a dispenser frame having a front end and a rear end, an upper support deck extending at least partially between said front end and said rear end, a lower support deck positioned below said upper support deck, said lower support deck defining a product display area, the upper support deck having a upper support deck front end and an upper support deck rear end, with at least one open region between the upper support deck front end and upper support deck rear end;

forming an opening in said container; and positioning said container on said upper support deck such that at least one product of said plurality of products passes through said opening and moves down to said lower support deck; and positioning an obstruction below said opening, the obstruction comprising a guide having:

an upper ramp having a first curved forward surface;

a lower ramp having a second curved forward surface;

the upper ramp and lower ramp intersecting at a forward-protruding curve end located at the lower end of the upper ramp and the upper end of the lower ramp;

wherein said product interacts with said obstruction as said product moves down to said lower support deck, and said interaction is sufficient to reduce a velocity of said product prior to said product contacting said lower support deck.

* * * * *